US010756455B2

(12) United States Patent
Bence et al.

(10) Patent No.: US 10,756,455 B2
(45) Date of Patent: Aug. 25, 2020

(54) ELECTRICAL CONNECTOR WITH GROUNDING MEMBER

(71) Applicant: Corning Optical Communications RF LLC, Glendale, AZ (US)

(72) Inventors: Bruce D. Bence, Glendale, AZ (US); Donald A. Burris, Peoria, AZ (US); Brian L. Kisling, Phoenix, AZ (US); John A. Kooiman, Peoria, AZ (US); William B. Lutz, Glendale, AZ (US); William F. McDade, Glendale, AZ (US); Thomas D. Miller, Peoria, AZ (US); Lee Yung Chuan, Sanchong (TW)

(73) Assignee: Corning Optical Communications RF LLC, Glendale, AZ (US)

( * ) Notice: Subject to any disclaimer, the term of this patent is extended or adjusted under 35 U.S.C. 154(b) by 93 days.

(21) Appl. No.: 14/166,653

(22) Filed: Jan. 28, 2014

(65) Prior Publication Data

US 2014/0148051 A1 May 29, 2014

Related U.S. Application Data

(63) Continuation of application No. 13/438,532, filed on Apr. 3, 2012, now Pat. No. 8,690,603, which is a (Continued)

(51) Int. Cl.
*H01R 9/05* (2006.01)
*H01R 24/44* (2011.01)
(Continued)

(52) U.S. Cl.
CPC ..... *H01R 9/05* (2013.01); *H01R 24/44* (2013.01); *H01R 43/20* (2013.01);
(Continued)

(58) Field of Classification Search
CPC ..... H01R 9/0521; H01R 9/0524; H01R 2103/00; H01R 24/564; H01R 24/40
(Continued)

(56) References Cited

U.S. PATENT DOCUMENTS 331,169 A 11/1885 Thomas
346,958 A 8/1886 Stone
(Continued)

FOREIGN PATENT DOCUMENTS

CA 2096710 11/1994
CN 201149936 11/2008
(Continued)

OTHER PUBLICATIONS

Office Action dated Dec. 31, 2014 pertaining to U.S. Appl. No. 13/605,498.
(Continued)

*Primary Examiner* — Abdullah A Riyami
*Assistant Examiner* — Vladimir Imas
(74) *Attorney, Agent, or Firm* — Tamika A. Crawl-Bey

(57) ABSTRACT

A coaxial cable connector for coupling a coaxial cable to an equipment port, the coaxial cable including a center conductor surrounded by a dielectric material, the dielectric material being surrounded by an outer conductor, the coaxial cable connector including: a post including a first end adapted to be inserted into a prepared end of the coaxial cable between the dielectric material and the outer conductor, wherein the post includes a second end including an enlarged shoulder, wherein the enlarged shoulder has a radial face that faces away from the first end of the post, wherein the radial face is substantially flat; a body member adjacent to the post; a coupler including an internally-threaded region for engaging the equipment port; and a grounding member contacting the post and the coupler,
(Continued)

wherein the grounding member provides an electrically-conductive grounding path through the post and the coupler while allowing the coupler to rotate, wherein the grounding member includes at least one resilient portion.

15 Claims, 8 Drawing Sheets

Related U.S. Application Data continuation of application No. 13/117,843, filed on May 27, 2011, now Pat. No. 8,172,612, which is a continuation of application No. 12/332,925, filed on Dec. 11, 2008, now Pat. No. 7,955,126, which is a continuation of application No. 11/541,903, filed on Oct. 2, 2006, now Pat. No. 7,479,035, which is a continuation of application No. 11/043,844, filed on Jan. 25, 2005, now Pat. No. 7,114,990.

(51) Int. Cl.
*H01R 43/20* (2006.01)
*H01R 13/52* (2006.01)
*H01R 103/00* (2006.01)

(52) U.S. Cl.
CPC ..... *H01R 13/5202* (2013.01); *H01R 13/5216* (2013.01); *H01R 2103/00* (2013.01)

(58) Field of Classification Search
USPC ..... 439/583, 584, 320, 322, 314
See application file for complete search history.

(56) References Cited

U.S. PATENT DOCUMENTS 459,951 A 9/1891 Warner
589,216 A 8/1897 McKee
1,371,742 A 3/1921 Dringman
1,488,175 A 3/1924 Strandell
1,667,485 A 4/1928 MacDonald
1,766,869 A 6/1930 Austin
1,801,999 A 4/1931 Bowman
1,885,761 A 11/1932 Peirce, Jr.
1,959,302 A 5/1934 Paige
2,013,526 A 9/1935 Schmitt
2,059,920 A 11/1936 Weatherhead, Jr.
2,102,495 A 12/1937 England
2,258,528 A 10/1941 Wurzburger
2,258,737 A 10/1941 Browne
2,325,549 A 7/1943 Ryzowitz
2,480,963 A 9/1949 Quinn
2,544,654 A 3/1951 Brown
2,549,647 A 4/1951 Turenne
2,694,187 A 11/1954 Nash
2,705,652 A 4/1955 Kaiser
2,743,505 A 5/1956 Hill
2,754,487 A 7/1956 Carr et al.
2,755,331 A 7/1956 Melcher
2,757,351 A 7/1956 Klostermann
2,762,025 A 9/1956 Melcher
2,785,384 A 3/1957 Wickesser
2,805,399 A 9/1957 Leeper
2,816,949 A 12/1957 Curtiss
2,870,420 A 1/1959 Malek
2,878,039 A 3/1959 Hoegee et al.
2,881,406 A 4/1959 Arson
2,963,536 A 12/1960 Kokalas
3,001,169 A 9/1961 Blonder
3,015,794 A 1/1962 Kishbaugh
3,051,925 A 8/1962 Felts
3,091,748 A 5/1963 Takes et al.
3,094,364 A 6/1963 Lingg
3,103,548 A 9/1963 Concelman
3,106,548 A 10/1963 Lavalou
3,140,106 A 7/1964 Thomas et al.
3,161,451 A 12/1964 Neidecker
3,184,706 A 5/1965 Atkins
3,193,309 A 7/1965 Morris
3,194,292 A 7/1965 Borowsky
3,196,382 A 7/1965 Morello, Jr.
3,206,540 A 9/1965 Cohen
3,245,027 A 4/1966 Ziegler, Jr.
3,275,913 A 9/1966 Blanchard et al.
3,278,890 A 10/1966 Cooney
3,281,756 A 10/1966 O'Keefe et al.
3,281,757 A 10/1966 Bonhomme
3,290,069 A 12/1966 Davis
3,292,136 A 12/1966 Somerset
3,320,575 A 5/1967 Brown et al.
3,321,732 A 5/1967 Forney, Jr.
3,336,563 A 8/1967 Hyslop
3,348,186 A 10/1967 Rosen
3,350,667 A 10/1967 Shreve
3,350,677 A 10/1967 Daum
3,355,698 A 11/1967 Keller
3,372,364 A 3/1968 O'Keefe et al.
3,373,243 A 3/1968 Janowiak et al.
3,390,374 A 6/1968 Forney, Jr.
3,406,373 A 10/1968 Forney, Jr.
3,430,184 A 2/1969 Acord
3,448,430 A 6/1969 Kelly
3,453,376 A 7/1969 Ziegler, Jr. et al.
3,465,281 A 9/1969 Florer
3,475,545 A 10/1969 Stark et al.
3,494,400 A 2/1970 McCoy et al.
3,498,647 A 3/1970 Schroder
3,499,671 A 3/1970 Osborne
3,501,737 A 3/1970 Harris et al.
3,517,373 A 6/1970 Jamon
3,526,871 A 9/1970 Hobart
3,533,051 A 10/1970 Ziegler, Jr.
3,537,065 A 10/1970 Winston
3,544,705 A 12/1970 Winston
3,551,882 A 12/1970 O'Keefe
3,564,487 A 2/1971 Upstone et al.
3,587,033 A 6/1971 Brorein et al.
3,596,933 A 8/1971 Luckenbill
3,601,776 A 8/1971 Curl
3,603,912 A 9/1971 Kelly
3,614,711 A 10/1971 Anderson et al.
3,622,952 A 11/1971 Hilbert
3,629,792 A 12/1971 Dorrell
3,633,150 A 1/1972 Schwartz
3,646,502 A 2/1972 Hutter et al.
3,663,926 A 5/1972 Brandt
3,665,371 A 5/1972 Cripps
3,668,612 A 6/1972 Nepovim
3,669,472 A * 6/1972 Nadsady ..... F16L 19/005 285/233
3,671,922 A 6/1972 Zerlin et al.
3,671,926 A 6/1972 Nepovim
3,678,444 A 7/1972 Stevens et al.
3,678,445 A 7/1972 Brancaloene
3,680,034 A 7/1972 Chow et al.
3,681,739 A 8/1972 Kornick
3,683,320 A 8/1972 Woods et al.
3,686,623 A 8/1972 Nijman
3,694,792 A 9/1972 Wallo
3,694,793 A 9/1972 Concelman
3,697,930 A 10/1972 Shirey
3,706,958 A 12/1972 Blanchenot
3,708,186 A 1/1973 Takagi et al.
3,710,005 A 1/1973 French
3,739,076 A 6/1973 Schwartz
3,744,007 A 7/1973 Horak
3,744,011 A 7/1973 Blanchenot
3,761,870 A 9/1973 Drezin et al.
3,778,535 A 12/1973 Forney, Jr.
3,781,762 A 12/1973 Quackenbush
3,781,898 A 12/1973 Holloway
3,783,178 A 1/1974 Philibert et al.
3,787,796 A 1/1974 Barr

(56) References Cited

U.S. PATENT DOCUMENTS 3,793,610 A 2/1974 Brishka
3,798,589 A 3/1974 Deardurff
3,808,580 A 4/1974 Johnson
3,810,076 A 5/1974 Hutter
3,824,026 A 7/1974 Gaskins
3,835,443 A 9/1974 Arnold et al.
3,836,700 A 9/1974 Niemeyer
3,845,453 A 10/1974 Hemmer
3,846,738 A 11/1974 Nepovim
3,847,463 A 11/1974 Hayward et al.
3,854,003 A 12/1974 Duret
3,854,789 A 12/1974 Kaplan
3,858,156 A 12/1974 Zarro
3,879,102 A 4/1975 Horak
3,886,301 A 5/1975 Cronin et al.
3,907,335 A 9/1975 Burge et al.
3,907,399 A 9/1975 Spinner
3,910,673 A 10/1975 Stokes
3,915,539 A 10/1975 Collins
3,936,132 A 2/1976 Hutter
3,937,547 A 2/1976 Lee-Kemp
3,953,097 A 4/1976 Graham
3,960,428 A 6/1976 Naus et al.
3,963,320 A 6/1976 Spinner
3,963,321 A 6/1976 Burger et al.
3,970,355 A 7/1976 Pitschi
3,972,013 A 7/1976 Shapiro
3,976,352 A 8/1976 Spinner
3,980,805 A 9/1976 Lipari
3,985,418 A 10/1976 Spinner
3,986,736 A 10/1976 Takagi et al.
4,012,105 A 3/1977 Biddle
4,017,139 A 4/1977 Nelson
4,022,966 A 5/1977 Gajajiva
4,030,742 A 6/1977 Eidelberg et al.
4,030,798 A 6/1977 Paoli
4,032,177 A 6/1977 Anderson
4,045,706 A 8/1977 Daffner et al.
4,046,451 A 9/1977 Juds et al.
4,053,200 A 10/1977 Pugner
4,056,043 A 11/1977 Sriramamurty et al.
4,059,330 A 11/1977 Shirey
4,079,343 A 3/1978 Nijman
4,082,404 A 4/1978 Flatt
4,090,028 A 5/1978 Vontobel
4,093,335 A 6/1978 Schwartz et al.
4,100,943 A 7/1978 Terada et al.
4,106,839 A 8/1978 Cooper
4,109,126 A 8/1978 Halbeck
4,118,097 A 10/1978 Budnick
4,125,308 A 11/1978 Schilling
4,126,372 A 11/1978 Hashimoto et al.
4,131,332 A 12/1978 Hogendobler et al.
4,136,897 A 1/1979 Haluch
4,150,250 A 4/1979 Lundeberg
4,153,320 A 5/1979 Townshend
4,156,554 A 5/1979 Aujla
4,165,911 A 8/1979 Laudig
4,168,921 A 9/1979 Blanchard
4,173,385 A 11/1979 Fenn et al.
4,174,875 A 11/1979 Wilson et al.
4,187,481 A 2/1980 Bourtos
4,193,655 A 3/1980 Herrmann, Jr.
4,194,338 A 3/1980 Trafton
4,197,628 A 4/1980 Conti et al.
4,206,963 A 6/1980 English et al.
4,212,487 A 7/1980 Jones et al.
4,225,162 A 9/1980 Dola
4,227,765 A 10/1980 Neumann et al.
4,229,714 A 10/1980 Yu
4,239,318 A 12/1980 Schwartz
4,250,348 A 2/1981 Kitagawa
4,260,212 A 4/1981 Ritchie
4,273,405 A 6/1981 Law
4,280,749 A 7/1981 Hemmer
4,285,564 A 8/1981 Spinner
4,290,663 A 9/1981 Fowler et al.
4,296,986 A * 10/1981 Herrmann, Jr. ..... H01R 13/53 439/322
4,307,926 A 12/1981 Smith
4,309,050 A 1/1982 Legris
4,310,211 A 1/1982 Bunnell et al.
4,322,121 A 3/1982 Riches et al.
4,326,768 A 4/1982 Punako
4,326,769 A 4/1982 Dorsey et al.
4,334,730 A 6/1982 Colwell et al.
4,339,166 A 7/1982 Dayton
4,345,375 A 8/1982 Hayward
4,346,958 A 8/1982 Blanchard
4,354,721 A 10/1982 Luzzi
4,358,174 A 11/1982 Dreyer
4,373,767 A 2/1983 Cairns
4,389,081 A 6/1983 Gallusser et al.
4,400,050 A 8/1983 Hayward
4,407,529 A 10/1983 Holman
4,408,821 A 10/1983 Forney, Jr.
4,408,822 A 10/1983 Nikitas
4,412,717 A 11/1983 Monroe
4,421,377 A 12/1983 Spinner
4,426,127 A 1/1984 Kubota
4,428,639 A 1/1984 Hillis
4,444,453 A 4/1984 Kirby et al.
4,447,107 A 5/1984 Major et al.
4,452,503 A 6/1984 Forney, Jr.
4,456,323 A 6/1984 Pitcher et al.
4,459,881 A 7/1984 Hughes, Jr.
4,462,653 A 7/1984 Flederbach et al.
4,464,000 A 8/1984 Werth et al.
4,464,001 A 8/1984 Collins
4,469,386 A 9/1984 Ackerman
4,470,657 A 9/1984 Deacon
4,477,132 A 10/1984 Moser et al.
4,484,792 A 11/1984 Tengler et al.
4,484,796 A 11/1984 Sato et al.
4,490,576 A 12/1984 Bolante et al.
4,491,685 A 1/1985 Drew et al.
4,506,943 A * 3/1985 Drogo ..... H01R 13/62 439/314
4,515,427 A 5/1985 Smit
4,525,017 A * 6/1985 Schildkraut ..... H01R 13/622 439/320
4,531,790 A 7/1985 Selvin
4,531,805 A * 7/1985 Werth ..... H01R 9/032 439/578
4,533,191 A 8/1985 Blackwood
4,540,231 A 9/1985 Forney, Jr.
RE31,995 E 10/1985 Ball
4,545,633 A 10/1985 McGeary
4,545,637 A 10/1985 Bosshard et al.
4,553,877 A 11/1985 Edvardsen
4,575,274 A 3/1986 Hayward
4,580,862 A 4/1986 Johnson
4,580,865 A 4/1986 Fryberger
4,583,811 A 4/1986 McMills
4,585,289 A 4/1986 Bocher
4,588,246 A 5/1986 Schildkraut et al.
4,593,964 A 6/1986 Forney, Jr. et al.
4,596,434 A 6/1986 Saba et al.
4,596,435 A 6/1986 Bickford
4,597,621 A 7/1986 Burns
4,598,959 A 7/1986 Selvin
4,598,961 A 7/1986 Cohen
4,600,263 A 7/1986 DeChamp et al.
4,613,199 A 9/1986 McGeary
4,614,390 A 9/1986 Baker
4,616,900 A 10/1986 Cairns
4,623,205 A 11/1986 Barron
4,632,487 A 12/1986 Wargula
4,634,213 A 1/1987 Larsson et al.
4,640,572 A 2/1987 Conlon
4,645,281 A 2/1987 Burger
4,647,135 A 3/1987 Reinhardt
4,650,228 A 3/1987 McMills et al.
4,655,159 A 4/1987 McMills

(56) References Cited

U.S. PATENT DOCUMENTS 4,655,534 A 4/1987 Stursa
4,660,921 A 4/1987 Hauver
4,666,190 A 5/1987 Yamabe et al.
4,666,231 A 5/1987 Sheesley et al.
4,668,043 A 5/1987 Saba et al.
4,670,574 A 6/1987 Malcolm
4,673,236 A 6/1987 Musolff et al.
4,674,809 A 6/1987 Hollyday et al.
4,674,818 A 6/1987 McMills et al.
4,676,577 A 6/1987 Szegda
4,682,832 A 7/1987 Punako et al.
4,684,201 A 8/1987 Hutter
4,688,876 A 8/1987 Morelli
4,688,878 A 8/1987 Cohen et al.
4,690,482 A 9/1987 Chamberland et al.
4,691,976 A 9/1987 Cowen
4,703,987 A 11/1987 Gullusser et al.
4,703,988 A 11/1987 Raux et al.
4,713,021 A 12/1987 Kobler
4,717,355 A 1/1988 Mattis
4,720,155 A 1/1988 Schildkraut et al.
4,728,301 A 3/1988 Hemmer et al.
4,734,050 A 3/1988 Negre et al.
4,734,666 A 3/1988 Ohya et al.
4,737,123 A 4/1988 Paler et al.
4,738,009 A 4/1988 Down et al.
4,738,628 A 4/1988 Rees
4,739,009 A 4/1988 Down et al.
4,739,126 A 4/1988 Gutter et al.
4,746,305 A 5/1988 Nomura
4,747,656 A 5/1988 Miyahara et al.
4,747,786 A 5/1988 Hayashi et al.
4,749,821 A 6/1988 Linton et al.
4,755,152 A 7/1988 Elliot et al.
4,757,297 A 7/1988 Frawley
4,759,729 A 7/1988 Kemppainen et al.
4,761,146 A 8/1988 Sohoel
4,772,222 A 9/1988 Laudig et al.
4,789,355 A 12/1988 Lee
4,789,759 A 12/1988 Jones
4,795,360 A 1/1989 Newman et al.
4,797,120 A 1/1989 Ulery
4,806,116 A 2/1989 Ackerman
4,807,891 A 2/1989 Neher
4,808,128 A 2/1989 Werth
4,810,017 A 3/1989 Knak et al.
4,813,886 A 3/1989 Roos et al.
4,820,185 A 4/1989 Moulin
4,834,675 A 5/1989 Samchisen
4,834,676 A 5/1989 Tackett
4,835,342 A 5/1989 Guginsky
4,836,580 A 6/1989 Farrell
4,836,801 A 6/1989 Ramirez
4,838,813 A 6/1989 Pauza et al.
4,846,731 A 7/1989 Alwine
4,854,893 A 8/1989 Morris
4,857,014 A 8/1989 Alf et al.
4,867,489 A 9/1989 Patel
4,867,706 A 9/1989 Tang
4,869,679 A 9/1989 Szegda
4,874,331 A 10/1989 Iverson
4,881,912 A 11/1989 Thommen et al.
4,892,275 A 1/1990 Szegda
4,902,246 A 2/1990 Samchisen
4,906,207 A 3/1990 Banning et al.
4,915,651 A 4/1990 Bout
4,921,447 A 5/1990 Capp et al.
4,923,412 A 5/1990 Morris
4,925,403 A 5/1990 Zorzy
4,927,385 A 5/1990 Cheng
4,929,188 A 5/1990 Lionetto et al.
4,934,960 A 6/1990 Capp et al.
4,938,718 A 7/1990 Guendel
4,941,846 A 7/1990 Guimond et al.
4,952,174 A 8/1990 Sucht et al.
4,957,456 A 9/1990 Olson et al.
4,963,105 A 10/1990 Lewis et al.
4,964,805 A 10/1990 Gabany
4,964,812 A 10/1990 Siemon et al.
4,973,265 A 11/1990 Heeren
4,976,632 A 12/1990 Riches
4,979,911 A 12/1990 Spencer
4,990,104 A 2/1991 Schieferly
4,990,105 A 2/1991 Karlovich
4,990,106 A 2/1991 Szegda
4,992,061 A 2/1991 Brush, Jr. et al.
5,002,503 A 3/1991 Campbell et al.
5,007,861 A 4/1991 Stirling
5,011,422 A 4/1991 Yeh
5,011,432 A 4/1991 Sucht et al.
5,018,822 A 5/1991 Freismuth et al.
5,021,010 A 6/1991 Wright
5,024,606 A 6/1991 Ming-Hwa
5,030,126 A 7/1991 Hanlon
5,037,328 A 8/1991 Karlovich
5,046,964 A 9/1991 Welsh et al.
5,052,947 A 10/1991 Brodie et al.
5,055,060 A 10/1991 Down et al.
5,059,139 A 10/1991 Spinner
5,059,747 A * 10/1991 Bawa ..... H02G 3/0675 174/541
5,062,804 A 11/1991 Jamet et al.
5,066,248 A 11/1991 Gaver, Jr. et al.
5,067,912 A 11/1991 Bickford et al.
5,073,129 A 12/1991 Szegda
5,074,809 A 12/1991 Rousseau et al.
5,080,600 A 1/1992 Baker et al.
5,083,943 A 1/1992 Tarrant
5,088,937 A 2/1992 Gabany
5,120,260 A 6/1992 Jackson
5,127,853 A 7/1992 McMills et al.
5,131,862 A 7/1992 Gershfeld
5,137,470 A 8/1992 Doles
5,137,471 A * 8/1992 Verespej ..... H01R 9/0518 439/322
5,139,440 A 8/1992 Volk et al.
5,141,448 A 8/1992 Mattingly et al.
5,141,451 A 8/1992 Down
5,149,274 A 9/1992 Gallusser et al.
5,150,924 A 9/1992 Yokomatsu et al.
5,154,636 A 10/1992 Vaccaro et al.
5,161,993 A 11/1992 Leibfried, Jr.
5,166,477 A 11/1992 Perin, Jr. et al.
5,167,545 A 12/1992 O'Brien et al.
5,169,323 A 12/1992 Kawai et al.
5,176,530 A 1/1993 Reylek
5,176,533 A 1/1993 Sakurai et al.
5,181,161 A 1/1993 Hirose et al.
5,183,417 A 2/1993 Bools
5,185,655 A 2/1993 Glenday, et al.
5,186,501 A 2/1993 Mano
5,186,655 A 2/1993 Glenday et al.
5,195,904 A 3/1993 Cyvoct
5,195,905 A 3/1993 Pesci
5,195,906 A 3/1993 Szegda
5,205,547 A 4/1993 Mattingly
5,205,761 A 4/1993 Nilsson
D335,487 S 5/1993 Volk et al.
5,207,602 A 5/1993 McMills et al.
5,215,477 A 6/1993 Weber et al.
5,217,391 A 6/1993 Fisher, Jr.
5,217,392 A 6/1993 Hosler, Sr.
5,217,393 A 6/1993 Del Negro et al.
5,221,216 A 6/1993 Gabany et al.
5,227,587 A 7/1993 Paterek
5,247,424 A 9/1993 Harris et al.
5,269,701 A 12/1993 Leibfried, Jr.
5,281,762 A 1/1994 Long et al.
5,283,853 A 2/1994 Szegda
5,284,449 A 2/1994 Vaccaro
5,294,864 A 3/1994 Do
5,295,864 A 3/1994 Birch et al.
5,316,348 A 5/1994 Franklin
5,316,494 A 5/1994 Flanagan et al.

(56) References Cited

U.S. PATENT DOCUMENTS 5,318,459 A 6/1994 Sheilds
5,321,205 A 6/1994 Bawa et al.
5,334,032 A 8/1994 Myers et al.
5,334,051 A 8/1994 Devine et al.
5,338,225 A 8/1994 Jacobsen et al.
5,342,218 A 8/1994 McMills et al.
5,352,134 A 10/1994 Jacobsen et al.
5,354,217 A 10/1994 Gabel et al.
5,362,250 A 11/1994 McMills et al.
5,362,251 A 11/1994 Bielak
5,366,260 A 11/1994 Wartluft
5,371,819 A 12/1994 Szegda
5,371,821 A 12/1994 Szegda
5,371,827 A 12/1994 Szegda
5,380,211 A 1/1995 Kawagauchi et al.
5,389,005 A 2/1995 Kodama
5,393,244 A 2/1995 Szegda
5,397,252 A 3/1995 Wang
5,413,504 A 5/1995 Kloecker et al.
5,431,583 A 7/1995 Szegda
5,435,745 A 7/1995 Booth
5,435,751 A 7/1995 Papenheim et al.
5,435,760 A 7/1995 Miklos
5,439,386 A 8/1995 Ellis et al.
5,444,810 A 8/1995 Szegda
5,455,548 A 10/1995 Grandchamp et al.
5,456,611 A 10/1995 Henry et al.
5,456,614 A 10/1995 Szegda
5,466,173 A 11/1995 Down
5,470,257 A 11/1995 Szegda
5,474,478 A 12/1995 Ballog
5,475,921 A 12/1995 Johnston
5,488,268 A 1/1996 Bauer et al.
5,490,033 A 2/1996 Cronin
5,490,801 A 2/1996 Fisher, Jr. et al.
5,494,454 A 2/1996 Johnsen
5,499,934 A 3/1996 Jacobsen et al.
5,501,616 A 3/1996 Holliday
5,511,305 A 4/1996 Garner
5,516,303 A 5/1996 Yohn et al.
5,525,076 A 6/1996 Down
5,542,861 A 8/1996 Anhalt et al.
5,548,088 A 8/1996 Gray et al.
5,550,521 A 8/1996 Bernaud et al.
5,564,938 A 10/1996 Shenkal et al.
5,571,028 A 11/1996 Szegda
5,586,910 A 12/1996 Del Negro et al.
5,595,499 A 1/1997 Zander et al.
5,598,132 A 1/1997 Stabile
5,607,320 A 3/1997 Wright
5,607,325 A 3/1997 Toma
5,609,501 A 3/1997 McMills et al.
5,620,339 A 4/1997 Gray et al.
5,632,637 A 5/1997 Diener
5,632,651 A 5/1997 Szegda
5,644,104 A 7/1997 Porter et al.
5,649,723 A 7/1997 Larsson
5,651,698 A 7/1997 Locati et al.
5,651,699 A 7/1997 Holliday
5,653,605 A 8/1997 Woehl et al.
5,667,405 A 9/1997 Holliday
5,681,172 A 10/1997 Moldenhauer
5,683,263 A 11/1997 Hsu
5,702,263 A 12/1997 Baumann et al.
5,722,856 A 3/1998 Fuchs et al.
5,735,704 A 4/1998 Anthony
5,743,131 A 4/1998 Holliday et al.
5,746,617 A 5/1998 Porter, Jr. et al.
5,746,619 A 5/1998 Harting et al.
5,759,618 A 6/1998 Taylor
5,769,652 A 6/1998 Wider
5,769,662 A 6/1998 Stabile et al.
5,774,344 A 6/1998 Casebolt
5,775,927 A 7/1998 Wider
5,788,289 A 8/1998 Cronley
5,791,698 A 8/1998 Wartluft et al.
5,797,633 A 8/1998 Katzer et al.
5,817,978 A 10/1998 Hermant et al.
5,863,220 A 1/1999 Holliday
5,874,603 A 2/1999 Arkles
5,877,452 A 3/1999 McConnell
5,879,191 A 3/1999 Burris
5,882,226 A 3/1999 Bell et al.
5,890,924 A 4/1999 Endo
5,897,795 A 4/1999 Lu et al.
5,906,511 A 5/1999 Bozzer et al.
5,917,153 A 6/1999 Geroldinger
5,921,793 A 7/1999 Phillips
5,938,465 A 8/1999 Fox, Sr.
5,944,548 A 8/1999 Saito
5,951,327 A 9/1999 Marik
5,954,708 A 9/1999 Lopez et al.
5,957,716 A 9/1999 Buckley et al.
5,967,852 A 10/1999 Follingstad et al.
5,975,479 A 11/1999 Suter
5,975,591 A 11/1999 Guest
5,975,949 A 11/1999 Holliday et al.
5,975,951 A 11/1999 Burris et al.
5,977,841 A 11/1999 Lee et al.
5,997,350 A 12/1999 Burris et al.
6,010,349 A 1/2000 Porter, Jr.
6,019,635 A 2/2000 Nelson
6,022,237 A 2/2000 Esh
6,032,358 A 3/2000 Wild
6,036,540 A 3/2000 Beloritsky
6,042,422 A 3/2000 Youtsey
6,048,229 A 4/2000 Lazaro, Jr.
6,053,743 A 4/2000 Mitchell et al.
6,053,769 A 4/2000 Kubota et al.
6,053,777 A 4/2000 Boyle
6,062,607 A 5/2000 Barthlomew
6,080,015 A 6/2000 Andreescu
6,083,030 A 7/2000 Wright
6,083,053 A 7/2000 Anderson, Jr. et al.
6,089,903 A 7/2000 Stafford Gray et al.
6,089,912 A 7/2000 Tallis et al.
6,089,913 A 7/2000 Holliday
6,093,043 A 7/2000 Gray et al.
6,095,828 A 8/2000 Burland
6,095,841 A 8/2000 Felps
6,123,550 A 9/2000 Burkert et al.
6,123,567 A 9/2000 McCarthy
6,126,487 A 10/2000 Rosenberger et al.
6,132,234 A 10/2000 Waidner et al.
6,142,812 A 11/2000 Hwang
6,146,197 A 11/2000 Holliday et al.
6,152,752 A 11/2000 Fukuda
6,152,753 A 11/2000 Johnson et al.
6,153,830 A 11/2000 Montena
6,162,995 A 12/2000 Bachle et al.
6,164,977 A 12/2000 Lester
6,174,206 B1 1/2001 Yentile et al.
6,183,298 B1 2/2001 Henningsen
6,199,913 B1 3/2001 Wang
6,199,920 B1 3/2001 Neustadtl
6,210,216 B1 4/2001 Tso-Chin et al.
6,210,219 B1 4/2001 Zhu et al.
6,210,222 B1 4/2001 Langham et al.
6,217,383 B1 4/2001 Holland et al.
6,238,240 B1 5/2001 Yu
6,239,359 B1 5/2001 Lilienthal, II et al.
6,241,553 B1 6/2001 Hsia
6,250,942 B1 6/2001 Lemke et al.
6,250,974 B1 6/2001 Kerek
6,257,923 B1 7/2001 Stone et al.
6,261,126 B1 7/2001 Stirling
6,267,612 B1 7/2001 Areykiewicz et al.
6,271,464 B1 8/2001 Cunningham
6,331,123 B1 12/2001 Rodrigues
6,332,815 B1 12/2001 Bruce
6,352,448 B1 3/2002 Holliday et al.
6,358,077 B1 3/2002 Young
6,361,348 B1 3/2002 Hall et al.
6,361,364 B1 3/2002 Holland et al.

(56) References Cited

U.S. PATENT DOCUMENTS

| | | | |
|---|---|---|---|
| 6,375,509 | B2 | 4/2002 | Mountford |
| 6,379,183 | B1 | 4/2002 | Ayres et al. |
| 6,394,840 | B1 | 5/2002 | Gassauer et al. |
| 6,396,367 | B1 | 5/2002 | Rosenberger |
| D458,904 | S | 6/2002 | Montena |
| 6,398,571 | B1 | 6/2002 | Nishide et al. |
| 6,406,330 | B2 | 6/2002 | Bruce |
| 6,409,534 | B1 | 6/2002 | Weisz-Margulescu |
| D460,739 | S | 7/2002 | Fox |
| D460,740 | S | 7/2002 | Montena |
| D460,946 | S | 7/2002 | Montena |
| D460,947 | S | 7/2002 | Montena |
| D460,948 | S | 7/2002 | Montena |
| 6,422,884 | B1 | 7/2002 | Babasick et al. |
| 6,422,900 | B1 | 7/2002 | Hogan |
| 6,425,782 | B1 | 7/2002 | Holland |
| D461,166 | S | 8/2002 | Montena |
| D461,167 | S | 8/2002 | Montena |
| D461,778 | S | 8/2002 | Fox |
| D462,058 | S | 8/2002 | Montena |
| D462,060 | S | 8/2002 | Fox |
| 6,439,899 | B1 | 8/2002 | Muzslay et al. |
| D462,327 | S | 9/2002 | Montena |
| 6,443,763 | B1 | 9/2002 | Richet |
| 6,450,829 | B1 | 9/2002 | Weisz-Margulescu |
| 6,454,463 | B1 | 9/2002 | Halbach |
| 6,464,526 | B1 | 10/2002 | Seufert et al. |
| 6,464,527 | B2 | 10/2002 | Volpe et al. |
| 6,467,816 | B1 | 10/2002 | Huang |
| 6,468,100 | B1 | 10/2002 | Meyer et al. |
| 6,491,546 | B1 | 12/2002 | Perry |
| D468,696 | S | 1/2003 | Montena |
| 6,506,083 | B1 | 1/2003 | Bickford et al. |
| 6,510,610 | B2 | 1/2003 | Losinger |
| 6,520,800 | B1 | 2/2003 | Michelbach et al. |
| 6,530,807 | B2 | 3/2003 | Rodrigues et al. |
| 6,540,531 | B2 | 4/2003 | Syed et al. |
| 6,558,194 | B2 | 5/2003 | Montena |
| 6,572,419 | B2 | 6/2003 | Feye-Homann |
| 6,576,833 | B2 | 6/2003 | Covaro et al. |
| 6,619,876 | B2 | 9/2003 | Vaitkus et al. |
| 6,634,906 | B1 | 10/2003 | Yeh |
| 6,637,101 | B2 | 10/2003 | Hathaway et al. |
| 6,645,011 | B2 | 11/2003 | Schneider et al. |
| 6,663,397 | B1 | 12/2003 | Lin et al. |
| 6,676,446 | B2 | 1/2004 | Montena |
| 6,683,253 | B1 | 1/2004 | Lee |
| 6,683,773 | B2 | 1/2004 | Montena |
| 6,692,285 | B2 | 2/2004 | Islam |
| 6,692,286 | B1 | 2/2004 | De Cet |
| 6,695,636 | B2 | 2/2004 | Hall et al. |
| 6,705,875 | B2 | 3/2004 | Berghorn et al. |
| 6,705,884 | B1 | 3/2004 | McCarthy |
| 6,709,280 | B1 | 3/2004 | Gretz |
| 6,709,289 | B2 | 3/2004 | Huber et al. |
| 6,712,631 | B1 | 3/2004 | Youtsey |
| 6,716,041 | B2 | 4/2004 | Ferderer et al. |
| 6,716,062 | B1 | 4/2004 | Palinkas et al. |
| 6,733,336 | B1 | 5/2004 | Montena et al. |
| 6,733,337 | B2 | 5/2004 | Kodaira |
| 6,743,040 | B1 | 6/2004 | Nakamura |
| 6,749,454 | B2 | 6/2004 | Schmidt et al. |
| 6,751,081 | B1 | 6/2004 | Kooiman |
| 6,752,633 | B2 | 6/2004 | Aizawa et al. |
| 6,761,571 | B2 | 7/2004 | Hida |
| 6,767,248 | B1 | 7/2004 | Hung |
| 6,769,926 | B1 | 8/2004 | Montena |
| 6,780,029 | B1 | 8/2004 | Gretz |
| 6,780,042 | B1 | 8/2004 | Badescu et al. |
| 6,780,052 | B2 | 8/2004 | Montena et al. |
| 6,780,068 | B2 | 8/2004 | Bartholoma et al. |
| 6,783,394 | B1 | 8/2004 | Holliday |
| 6,786,767 | B1 | 9/2004 | Fuks et al. |
| 6,790,081 | B2 | 9/2004 | Burris et al. |
| 6,793,528 | B2 | 9/2004 | Lin et al. |
| 6,796,847 | B2 | 9/2004 | AbuGhezaleh |
| 6,802,738 | B1 | 10/2004 | Henningsen |
| 6,805,581 | B2 | 10/2004 | Chen |
| 6,805,583 | B2 | 10/2004 | Holliday et al. |
| 6,805,584 | B1 | 10/2004 | Chen |
| 6,808,415 | B1 | 10/2004 | Montena |
| 6,817,272 | B2 | 11/2004 | Holland |
| 6,817,896 | B2 | 11/2004 | Derenthal |
| 6,817,897 | B2 | 11/2004 | Chee |
| 6,827,608 | B2 | 12/2004 | Hall et al. |
| 6,830,479 | B2 | 12/2004 | Holliday |
| 6,848,115 | B2 | 1/2005 | Sugiura et al. |
| 6,848,939 | B2 | 2/2005 | Stirling |
| 6,848,940 | B2 | 2/2005 | Montena |
| 6,848,941 | B2 | 2/2005 | Wlos et al. |
| 6,884,113 | B1 | 4/2005 | Montena |
| 6,884,115 | B2 | 4/2005 | Malloy |
| 6,887,102 | B1 | 5/2005 | Burris et al. |
| 6,916,200 | B2 | 7/2005 | Burris et al. |
| 6,929,265 | B2 | 8/2005 | Holland et al. |
| 6,929,508 | B1 | 8/2005 | Holland |
| 6,935,866 | B2 | 8/2005 | Kerekes et al. |
| 6,939,169 | B2 | 9/2005 | Islam et al. |
| 6,942,516 | B2 | 9/2005 | Shimoyama et al. |
| 6,942,520 | B2 | 9/2005 | Barlian et al. |
| 6,945,805 | B1 | 9/2005 | Bollinger |
| 6,948,976 | B2 | 9/2005 | Goodwin et al. |
| 6,953,371 | B2 | 10/2005 | Baker et al. |
| 6,955,563 | B1 | 10/2005 | Croan |
| D511,497 | S | 11/2005 | Murphy et al. |
| D512,024 | S | 11/2005 | Murphy et al. |
| D512,689 | S | 12/2005 | Murphy et al. |
| 6,971,912 | B2 | 12/2005 | Montena et al. |
| 7,008,263 | B2 | 3/2006 | Holland |
| 7,018,216 | B1 | 3/2006 | Clark et al. |
| 7,018,235 | B1 | 3/2006 | Burris et al. |
| 7,029,326 | B2 | 4/2006 | Montena |
| D521,454 | S | 5/2006 | Murphy et al. |
| 7,063,565 | B2 | 6/2006 | Ward |
| 7,070,447 | B1 | 7/2006 | Montena |
| 7,077,697 | B2 | 7/2006 | Kooiman |
| 7,077,699 | B2 | 7/2006 | Islam et al. |
| 7,086,897 | B2 | 8/2006 | Montena |
| 7,090,525 | B1 | 8/2006 | Morana |
| 7,094,114 | B2 | 8/2006 | Kurimoto |
| 7,097,499 | B1 | 8/2006 | Purdy |
| 7,102,868 | B2 | 9/2006 | Montena |
| 7,108,547 | B2 | 9/2006 | Kisling et al. |
| 7,108,548 | B2 | 9/2006 | Burris et al. |
| 7,112,078 | B2 | 9/2006 | Czikora |
| 7,112,093 | B1 | 9/2006 | Holland |
| 7,114,990 | B2 | 10/2006 | Bence et al. |
| 7,117,990 | B2 | 10/2006 | Sarif |
| 7,118,285 | B2 | 10/2006 | Fenwick et al. |
| 7,118,382 | B2 | 10/2006 | Kerekes et al. |
| 7,118,416 | B2 | 10/2006 | Montena et al. |
| 7,125,283 | B1 | 10/2006 | Lin |
| 7,128,603 | B2 | 10/2006 | Burris et al. |
| 7,128,604 | B2 | 10/2006 | Hall |
| 7,131,867 | B1 | 11/2006 | Foster et al. |
| 7,131,868 | B2 | 11/2006 | Montena |
| 7,140,645 | B2 | 11/2006 | Cronley |
| 7,144,271 | B1 | 12/2006 | Burris et al. |
| 7,144,272 | B1 | 12/2006 | Burris et al. |
| 7,147,509 | B1 | 12/2006 | Burris et al. |
| 7,153,159 | B2 | 12/2006 | Burris et al. |
| 7,156,696 | B1 | 1/2007 | Montena |
| 7,161,785 | B2 | 1/2007 | Chawgo |
| 7,165,974 | B2 | 1/2007 | Kooiman |
| 7,173,121 | B2 | 2/2007 | Fang |
| 7,179,121 | B1 | 2/2007 | Burris et al. |
| 7,179,122 | B2 | 2/2007 | Holliday |
| 7,182,639 | B2 | 2/2007 | Burris |
| 7,183,639 | B2 | 2/2007 | Mihara et al. |
| 7,189,097 | B2 | 3/2007 | Benham |
| 7,189,114 | B1 | 3/2007 | Burris et al. |
| 7,192,308 | B2 | 3/2007 | Rodrigues et al. |
| 7,229,303 | B2 | 6/2007 | Vermoesen et al. |
| 7,238,047 | B2 | 7/2007 | Saetele et al. |

(56) References Cited

U.S. PATENT DOCUMENTS

| | | | |
|---|---|---|---|
| 7,252,536 | B2 | 8/2007 | Lazaro, Jr. et al. |
| 7,252,546 | B1 | 8/2007 | Holland |
| 7,255,598 | B2 | 8/2007 | Montena et al. |
| 7,261,594 | B2 | 8/2007 | Kodama et al. |
| 7,264,502 | B2 | 9/2007 | Holland |
| 7,278,882 | B1 | 10/2007 | Li |
| 7,288,002 | B2 | 10/2007 | Rodrigues et al. |
| 7,291,033 | B2 | 11/2007 | Hu |
| 7,297,023 | B2 | 11/2007 | Chawgo |
| 7,299,550 | B2 | 11/2007 | Montena |
| 7,303,435 | B2 | 12/2007 | Burris et al. |
| 7,311,555 | B1 | 12/2007 | Burris et al. |
| 7,318,609 | B2 | 1/2008 | Naito et al. |
| 7,322,846 | B2 | 1/2008 | Camelio |
| 7,322,851 | B2 | 1/2008 | Brookmire |
| 7,329,139 | B2 | 2/2008 | Benham |
| 7,331,820 | B2 | 2/2008 | Burris et al. |
| 7,335,058 | B1 | 2/2008 | Burris et al. |
| 7,347,129 | B1 | 3/2008 | Youtsey |
| 7,347,726 | B2 | 3/2008 | Wlos |
| 7,347,727 | B2 | 3/2008 | Wlos et al. |
| 7,347,729 | B2 | 3/2008 | Thomas et al. |
| 7,351,088 | B1 | 4/2008 | Qu |
| 7,357,641 | B2 | 4/2008 | Kerekes et al. |
| 7,364,462 | B2 | 4/2008 | Holland |
| 7,371,112 | B2 | 5/2008 | Burris et al. |
| 7,371,113 | B2 | 5/2008 | Burris et al. |
| 7,375,533 | B2 | 5/2008 | Gale |
| 7,387,524 | B2 | 6/2008 | Cheng |
| 7,393,245 | B2 | 7/2008 | Palinkas et al. |
| 7,396,249 | B2 | 7/2008 | Kauffman |
| 7,404,737 | B1 | 7/2008 | Youtsey |
| 7,410,389 | B2 | 8/2008 | Holliday |
| 7,416,415 | B2 | 8/2008 | Hart et al. |
| 7,438,327 | B2 | 10/2008 | Auray et al. |
| 7,452,239 | B2 | 11/2008 | Montena |
| 7,455,550 | B1 | 11/2008 | Sykes |
| 7,458,850 | B1 | 12/2008 | Burris et al. |
| 7,458,851 | B2 | 12/2008 | Montena |
| 7,462,068 | B2 | 12/2008 | Amidon |
| 7,467,980 | B2 | 12/2008 | Chiu |
| 7,476,127 | B1 | 1/2009 | Wei |
| 7,478,475 | B2 | 1/2009 | Hall |
| 7,479,033 | B1 | 1/2009 | Sykes et al. |
| 7,479,035 | B2 | 1/2009 | Bence et al. |
| 7,484,988 | B2 | 2/2009 | Ma et al. |
| 7,484,997 | B2 | 2/2009 | Hofling |
| 7,488,210 | B1 | 2/2009 | Burris et al. |
| 7,494,355 | B2 | 2/2009 | Hughes et al. |
| 7,497,729 | B1 | 3/2009 | Wei |
| 7,500,868 | B2 | 3/2009 | Holland et al. |
| 7,500,873 | B1 | 3/2009 | Hart |
| 7,507,116 | B2 | 3/2009 | Laerke et al. |
| 7,507,117 | B2 | 3/2009 | Amidon |
| 7,513,788 | B2 | 4/2009 | Camelio |
| 7,537,482 | B2 | 5/2009 | Burris et al. |
| 7,540,759 | B2 | 6/2009 | Liu et al. |
| 7,544,094 | B1 | 6/2009 | Paglia et al. |
| 7,563,133 | B2 | 7/2009 | Stein |
| 7,566,236 | B2 | 7/2009 | Malloy et al. |
| 7,568,945 | B2 | 8/2009 | Chee et al. |
| 7,578,693 | B2 | 8/2009 | Yoshida et al. |
| 7,588,454 | B2 | 9/2009 | Nakata et al. |
| 7,607,942 | B1 | 10/2009 | Van Swearingen |
| 7,625,227 | B1 | 12/2009 | Henderson et al. |
| 7,632,143 | B1 | 12/2009 | Islam |
| 7,635,283 | B1 | 12/2009 | Islam |
| 7,648,383 | B2 | 1/2010 | Burris et al. |
| 7,651,376 | B2 | 1/2010 | Schreier |
| 7,674,132 | B1 | 3/2010 | Chen |
| 7,682,177 | B2 | 3/2010 | Berthet |
| 7,694,420 | B2 | 4/2010 | Ehret et al. |
| 7,714,229 | B2 | 5/2010 | Burris et al. |
| 7,726,996 | B2 | 6/2010 | Burris et al. |
| 7,727,011 | B2 | 6/2010 | Montena et al. |
| 7,749,021 | B2 | 7/2010 | Brodeur |
| 7,753,705 | B2 | 7/2010 | Montena |
| 7,753,710 | B2 | 7/2010 | George |
| 7,753,727 | B1 | 7/2010 | Islam et al. |
| 7,758,356 | B2 | 7/2010 | Burris et al. |
| 7,758,370 | B1 | 7/2010 | Flaherty |
| 7,794,275 | B2 | 9/2010 | Rodrigues |
| 7,806,714 | B2 | 10/2010 | Williams et al. |
| 7,806,725 | B1 | 10/2010 | Chen |
| 7,811,133 | B2 | 10/2010 | Gray |
| 7,814,654 | B2 | 10/2010 | Pichler |
| D626,920 | S | 11/2010 | Purdy et al. |
| 7,824,216 | B2 | 11/2010 | Purdy |
| 7,828,594 | B2 | 11/2010 | Burris et al. |
| 7,828,595 | B2 | 11/2010 | Mathews |
| 7,830,154 | B2 | 11/2010 | Gale |
| 7,833,053 | B2 | 11/2010 | Mathews |
| 7,845,976 | B2 | 12/2010 | Mathews |
| 7,845,978 | B1 | 12/2010 | Chen |
| 7,845,980 | B1 | 12/2010 | Amidon |
| 7,850,472 | B2 | 12/2010 | Friedrich et al. |
| 7,850,487 | B1 | 12/2010 | Wei |
| 7,857,661 | B1 | 12/2010 | Islam |
| 7,874,870 | B1 | 1/2011 | Chen |
| 7,887,354 | B2 | 2/2011 | Holliday |
| 7,892,004 | B2 | 2/2011 | Hertzler et al. |
| 7,892,005 | B2 | 2/2011 | Haube |
| 7,892,024 | B1 | 2/2011 | Chen |
| 7,914,326 | B2 | 3/2011 | Sutter |
| 7,918,687 | B2 | 4/2011 | Paynter et al. |
| 7,927,135 | B1 | 4/2011 | Wlos |
| 7,934,955 | B1 | 5/2011 | Hsia |
| 7,938,662 | B2 | 5/2011 | Burris et al. |
| 7,942,695 | B1 | 5/2011 | Lu |
| 7,950,958 | B2 | 5/2011 | Mathews |
| 7,950,961 | B2 | 5/2011 | Chabalowski et al. |
| 7,955,126 | B2 | 6/2011 | Bence et al. |
| 7,972,158 | B2 | 7/2011 | Wild et al. |
| 7,972,176 | B2 | 7/2011 | Burris et al. |
| 7,982,005 | B2 | 7/2011 | Ames et al. |
| 8,011,955 | B1 | 9/2011 | Lu |
| 8,025,518 | B2 | 9/2011 | Burris et al. |
| 8,029,315 | B2 | 10/2011 | Purdy et al. |
| 8,029,316 | B2 | 10/2011 | Snyder et al. |
| 8,037,599 | B2 | 10/2011 | Pichler |
| 8,047,872 | B2 | 11/2011 | Burris et al. |
| 8,062,044 | B2 | 11/2011 | Montena et al. |
| 8,062,063 | B2 | 11/2011 | Malloy et al. |
| 8,070,504 | B2 | 12/2011 | Amidon et al. |
| 8,075,337 | B2 | 12/2011 | Malloy et al. |
| 8,075,338 | B1 | 12/2011 | Montena |
| 8,079,860 | B1 | 12/2011 | Zraik |
| 8,087,954 | B2 | 1/2012 | Fuchs |
| 8,113,875 | B2 | 2/2012 | Malloy et al. |
| 8,113,879 | B1 | 2/2012 | Zraik |
| 8,157,587 | B2 | 4/2012 | Paynter et al. |
| 8,157,588 | B1 | 4/2012 | Rodrigues et al. |
| 8,167,635 | B1 | 5/2012 | Mathews |
| 8,167,636 | B1 | 5/2012 | Montena |
| 8,172,612 | B2 | 5/2012 | Bence et al. |
| 8,177,572 | B2 | 5/2012 | Feye-Hohmann |
| 8,192,237 | B2 | 6/2012 | Purdy et al. |
| 8,206,172 | B2 | 6/2012 | Katagiri et al. |
| D662,893 | S | 7/2012 | Haberek et al. |
| 8,231,412 | B2 | 7/2012 | Paglia et al. |
| 8,262,408 | B1 | 9/2012 | Kelly |
| 8,272,893 | B2 | 9/2012 | Burris et al. |
| 8,287,310 | B2 | 10/2012 | Burris et al. |
| 8,287,320 | B2 | 10/2012 | Purdy et al. |
| 8,313,345 | B2 | 11/2012 | Purdy |
| 8,313,353 | B2 | 11/2012 | Purdy et al. |
| 8,317,539 | B2 | 11/2012 | Stein |
| 8,319,136 | B2 | 11/2012 | Byron et al. |
| 8,323,053 | B2 | 12/2012 | Montena |
| 8,323,058 | B2 | 12/2012 | Flaherty et al. |
| 8,323,060 | B2 | 12/2012 | Purdy et al. |
| 8,337,229 | B2 | 12/2012 | Montena |
| 8,366,481 | B2 | 2/2013 | Ehret et al. |
| 8,366,482 | B2 | 2/2013 | Burris et al. |

(56) References Cited

U.S. PATENT DOCUMENTS 8,376,769 B2 2/2013 Holland et al.
D678,844 S 3/2013 Haberek
8,398,421 B2 3/2013 Haberek et al.
8,430,688 B2 4/2013 Montena et al.
8,449,326 B2 5/2013 Holland et al.
8,465,322 B2 6/2013 Purdy
8,469,739 B2 6/2013 Rodrigues et al.
8,469,740 B2 6/2013 Ehret et al.
D686,164 S 7/2013 Haberek et al.
D686,576 S 7/2013 Haberek et al.
8,475,205 B2 7/2013 Ehret et al.
8,480,430 B2 7/2013 Ehret et al.
8,480,431 B2 7/2013 Ehret et al.
8,485,845 B2 7/2013 Ehret et al.
8,506,325 B2 8/2013 Malloy et al.
8,517,763 B2 8/2013 Burris et al.
8,517,764 B2 8/2013 Wei et al.
8,529,279 B2 9/2013 Montena
8,550,835 B2 10/2013 Montena
8,568,163 B2 10/2013 Burris et al.
8,568,165 B2 10/2013 Wei et al.
8,591,244 B2 11/2013 Thomas et al.
8,597,050 B2 12/2013 Flaherty et al.
8,622,776 B2 1/2014 Morikawa
8,636,529 B2 1/2014 Stein
8,636,541 B2 1/2014 Chastain et al.
8,647,136 B2 2/2014 Purdy et al.
7,114,990 C1 4/2014 Bence et al.
8,690,603 B2 4/2014 Bence et al.
8,721,365 B2 5/2014 Holland
8,727,800 B2 5/2014 Holland et al.
8,777,658 B2 7/2014 Holland et al.
8,777,661 B2 7/2014 Holland et al.
8,172,612 C1 9/2014 Bence et al.
8,858,251 B2 10/2014 Montena
8,888,526 B2 11/2014 Burris
8,920,192 B2 12/2014 Montena
6,558,194 C1 1/2015 Montena
6,848,940 C1 1/2015 Montena
9,017,101 B2 4/2015 Ehret et al.
9,048,599 B2 6/2015 Burris
9,153,911 B2 10/2015 Burris et al.
9,166,348 B2 10/2015 Burris et al.
9,172,154 B2 10/2015 Burris
9,172,157 B2 10/2015 Burris
2001/0034143 A1 10/2001 Annequin
2001/0046802 A1 11/2001 Perry et al.
2001/0051448 A1 12/2001 Gonzalez
2002/0013088 A1 1/2002 Rodrigues et al.
2002/0019161 A1 2/2002 Finke et al.
2002/0038720 A1 4/2002 Kai et al.
2002/0146935 A1 10/2002 Wong
2003/0110977 A1 6/2003 Batlaw
2003/0119358 A1 6/2003 Henningsen
2003/0139081 A1 7/2003 Hall et al.
2003/0194890 A1 10/2003 Ferderer et al.
2003/0214370 A1 11/2003 Allison et al.
2003/0224657 A1 12/2003 Malloy
2004/0031144 A1 2/2004 Holland
2004/0077215 A1 4/2004 Palinkas et al.
2004/0102089 A1 5/2004 Chee
2004/0137778 A1 7/2004 Mattheeuws et al.
2004/0157499 A1 8/2004 Nania et al.
2004/0194585 A1 10/2004 Clark
2004/0209516 A1* 10/2004 Burris ..... H01R 9/0521 439/587
2004/0219833 A1 11/2004 Burris et al.
2004/0229504 A1 11/2004 Liu
2005/0042919 A1 2/2005 Montena
2005/0079762 A1 4/2005 Hsia
2005/0159045 A1 7/2005 Huang
2005/0170692 A1 8/2005 Montena
2005/0181652 A1 8/2005 Montena et al.
2005/0181668 A1 8/2005 Montena et al.
2005/0208827 A1 9/2005 Burris et al.
2005/0219833 A1 10/2005 Wu et al.
2005/0233636 A1 10/2005 Rodrigues et al.
2006/0014425 A1 1/2006 Montena
2006/0099853 A1 5/2006 Sattele et al.
2006/0110977 A1* 5/2006 Matthews ..... H01R 9/0524 439/578
2006/0113107 A1 6/2006 Williams
2006/0154519 A1 7/2006 Montena
2006/0166552 A1 7/2006 Bence et al.
2006/0178046 A1 8/2006 Tusini
2006/0194465 A1 8/2006 Czikora
2006/0199040 A1 9/2006 Yamada
2006/0223355 A1 10/2006 Hirschmann
2006/0246774 A1 11/2006 Buck
2006/0258209 A1 11/2006 Hall
2006/0276079 A1 12/2006 Chen
2007/0004276 A1 1/2007 Stein
2007/0026734 A1 2/2007 Bence et al.
2007/0049113 A1 3/2007 Rodrigues et al.
2007/0054535 A1 3/2007 Hall et al.
2007/0059968 A1 3/2007 Ohtaka et al.
2007/0082533 A1 4/2007 Currier et al.
2007/0087613 A1 4/2007 Schumacher et al.
2007/0123101 A1 5/2007 Palinkas
2007/0155232 A1 7/2007 Burris et al.
2007/0173100 A1 7/2007 Benham
2007/0175027 A1 8/2007 Khemakhem et al.
2007/0232117 A1 10/2007 Singer
2007/0243759 A1 10/2007 Rodrigues et al.
2007/0243762 A1 10/2007 Burke et al.
2007/0287328 A1 12/2007 Hart et al.
2008/0032556 A1 2/2008 Schreier
2008/0102696 A1 5/2008 Montena
2008/0171466 A1 7/2008 Buck et al.
2008/0200066 A1 8/2008 Hofling
2008/0200068 A1 8/2008 Aguirre
2008/0214040 A1 9/2008 Holterhoff et al.
2008/0289470 A1 11/2008 Aston
2008/0310026 A1 12/2008 Nakayama
2009/0029590 A1 1/2009 Sykes et al.
2009/0098770 A1 4/2009 Bence et al.
2009/0104801 A1 4/2009 Silva
2009/0163075 A1 6/2009 Blew et al.
2009/0186505 A1 7/2009 Mathews
2009/0264003 A1 10/2009 Hertzler et al.
2009/0305560 A1 12/2009 Chen
2010/0007441 A1 1/2010 Yagisawa et al.
2010/0022125 A1 1/2010 Burris et al.
2010/0028563 A1 2/2010 Ota
2010/0055978 A1 3/2010 Montena
2010/0080563 A1 4/2010 DiFonzo et al.
2010/0081321 A1 4/2010 Malloy et al.
2010/0081322 A1 4/2010 Malloy et al.
2010/0087071 A1 4/2010 DiFonzo et al.
2010/0105246 A1 4/2010 Burris et al.
2010/0124839 A1 5/2010 Montena
2010/0130060 A1 5/2010 Islam
2010/0178799 A1 7/2010 Lee
2010/0216339 A1 8/2010 Burris et al.
2010/0233901 A1 9/2010 Wild et al.
2010/0233902 A1 9/2010 Youtsey
2010/0233903 A1 9/2010 Islam
2010/0255719 A1 10/2010 Purdy
2010/0255721 A1 10/2010 Purdy et al.
2010/0279548 A1 11/2010 Montena et al.
2010/0297871 A1 11/2010 Haube
2010/0297875 A1 11/2010 Purdy et al.
2010/0304579 A1 12/2010 Kisling
2010/0323541 A1 12/2010 Amidon et al.
2011/0021072 A1 1/2011 Purdy
2011/0021075 A1 1/2011 Orner et al.
2011/0027039 A1 2/2011 Blair
2011/0039448 A1 2/2011 Stein
2011/0053413 A1 3/2011 Mathews
2011/0074388 A1 3/2011 Bowman
2011/0080158 A1 4/2011 Lawrence et al.
2011/0111623 A1 5/2011 Burris et al.
2011/0111626 A1 5/2011 Paglia et al.
2011/0117774 A1 5/2011 Malloy et al.

(56) References Cited

U.S. PATENT DOCUMENTS

| | | | |
|---|---|---|---|
| 2011/0143567 | A1 | 6/2011 | Purdy et al. |
| 2011/0151714 | A1 | 6/2011 | Flaherty et al. |
| 2011/0230089 | A1 | 9/2011 | Amidon et al. |
| 2011/0230091 | A1 | 9/2011 | Krenceski et al. |
| 2011/0237123 | A1 | 9/2011 | Burris et al. |
| 2011/0237124 | A1 | 9/2011 | Flaherty et al. |
| 2011/0250789 | A1 | 10/2011 | Burris et al. |
| 2011/0318958 | A1 | 12/2011 | Burris et al. |
| 2012/0021642 | A1 | 1/2012 | Zraik |
| 2012/0040537 | A1 | 2/2012 | Burris |
| 2012/0045933 | A1 | 2/2012 | Youtsey |
| 2012/0064768 | A1 | 3/2012 | Islam et al. |
| 2012/0094530 | A1 | 4/2012 | Montena |
| 2012/0100751 | A1 | 4/2012 | Montena |
| 2012/0108098 | A1 | 5/2012 | Burris et al. |
| 2012/0122329 | A1 | 5/2012 | Montena |
| 2012/0129387 | A1 | 5/2012 | Holland et al. |
| 2012/0171894 | A1 | 7/2012 | Malloy et al. |
| 2012/0178289 | A1 | 7/2012 | Holliday |
| 2012/0202378 | A1 | 8/2012 | Krenceski et al. |
| 2012/0222302 | A1 | 9/2012 | Purdy et al. |
| 2012/0225581 | A1 | 9/2012 | Amidon et al. |
| 2012/0315788 | A1 | 12/2012 | Montena |
| 2013/0065433 | A1 | 3/2013 | Burris |
| 2013/0072057 | A1 | 3/2013 | Burris |
| 2013/0178096 | A1 | 7/2013 | Matzen |
| 2013/0273761 | A1 | 10/2013 | Ehret et al. |
| 2014/0106612 | A1 | 4/2014 | Burris |
| 2014/0106613 | A1 | 4/2014 | Burris |
| 2014/0120766 | A1 | 5/2014 | Meister et al. |
| 2014/0137393 | A1 | 5/2014 | Chastain et al. |
| 2014/0148044 | A1 | 5/2014 | Balcer et al. |
| 2014/0148051 | A1 | 5/2014 | Bence et al. |
| 2014/0154907 | A1 | 6/2014 | Ehret et al. |
| 2014/0298650 | A1 | 10/2014 | Chastain et al. |
| 2014/0322968 | A1 | 10/2014 | Burris |
| 2014/0342605 | A1 | 11/2014 | Burris et al. |
| 2015/0118901 | A1 | 4/2015 | Burris |
| 2015/0295331 | A1 | 10/2015 | Burris |

FOREIGN PATENT DOCUMENTS

| | | | |
|---|---|---|---|
| CN | 201149937 | | 11/2008 |
| CN | 201178228 | | 1/2009 |
| CN | 201904508 | | 7/2011 |
| DE | 47931 | | 10/1888 |
| DE | 102289 | | 7/1897 |
| DE | 1117687 | | 11/1961 |
| DE | 1191880 | | 4/1965 |
| DE | 1515398 | B1 | 4/1970 |
| DE | 2225764 | A1 | 12/1972 |
| DE | 2221936 | A1 | 11/1973 |
| DE | 2261973 | | 6/1974 |
| DE | 3117320 | | 4/1982 |
| DE | 3211008 | | 10/1983 |
| DE | 3211008 | A1 | 10/1983 |
| DE | 9001608.4 | | 4/1990 |
| DE | 4439852 | | 5/1996 |
| DE | 19749130 | | 8/1999 |
| DE | 19957518 | | 9/2001 |
| DE | 10346914 | | 5/2004 |
| EP | 115179 | | 8/1984 |
| EP | 116157 | | 8/1984 |
| EP | 167738 | | 1/1986 |
| EP | 72104 | | 2/1986 |
| EP | 223464 | | 5/1987 |
| EP | 265276 | | 4/1988 |
| EP | 350835 | | 1/1990 |
| EP | 428424 | | 5/1991 |
| EP | 867978 | | 9/1998 |
| EP | 1069654 | | 9/1998 |
| EP | 1094565 | | 4/2001 |
| EP | 1115179 | | 7/2001 |
| EP | 1191268 | | 3/2002 |
| EP | 1455420 | | 9/2004 |
| EP | 1501159 | | 1/2005 |
| EP | 1548898 | | 6/2005 |
| EP | 1603200 | | 12/2005 |
| EP | 1701410 | | 9/2006 |
| EP | 2051340 | | 4/2009 |
| FR | 2204331 | | 5/1974 |
| FR | 2232846 | | 1/1975 |
| FR | 2234680 | A2 | 1/1975 |
| FR | 2312918 | A1 | 12/1976 |
| FR | 2462798 | | 2/1981 |
| FR | 2494508 | | 5/1982 |
| GB | 589697 | | 6/1947 |
| GB | 1087228 | | 10/1967 |
| GB | 1270846 | | 4/1972 |
| GB | 1332888 | | 10/1973 |
| GB | 1332888 | A | 10/1973 |
| GB | 1401373 | | 7/1975 |
| GB | 1421215 | | 1/1976 |
| GB | 2019665 | | 10/1979 |
| GB | 2079549 | | 1/1982 |
| GB | 2252677 | | 8/1992 |
| GB | 2264201 | | 8/1993 |
| GB | 2331634 | | 5/1999 |
| GB | 2448595 | | 10/2008 |
| GB | 2450248 | | 12/2008 |
| GB | 2477479 | A | 8/2011 |
| JP | 3280369 | | 12/1991 |
| JP | 200215823 | | 1/2002 |
| JP | 4129978 | | 8/2008 |
| JP | 2009277571 | | 11/2009 |
| JP | 4391268 | | 12/2009 |
| JP | 4503793 | | 7/2010 |
| KR | 100622526 | | 9/2006 |
| TW | 427044 | | 3/2001 |
| WO | 87/00351 | A1 | 1/1987 |
| WO | 8700351 | | 1/1987 |
| WO | 00/05785 | | 2/2000 |
| WO | 0186756 | | 11/2001 |
| WO | 02069457 | | 9/2002 |
| WO | 2004013883 | | 2/2004 |
| WO | 2004098795 | | 11/2004 |
| WO | 2006081141 | | 8/2006 |
| WO | 2007062845 | | 6/2007 |
| WO | 2009066705 | | 5/2009 |
| WO | 2010135181 | | 11/2010 |
| WO | 2011057033 | | 5/2011 |
| WO | 2011128665 | | 10/2011 |
| WO | 2011128666 | | 10/2011 |
| WO | 2012162431 | | 11/2012 |
| WO | 2013126629 | | 8/2013 |

OTHER PUBLICATIONS

Office Action dated Dec. 16, 2014 pertaining to U.S. Appl. No. 13/653,095.

Office Action dated Dec. 19, 2014 pertaining to U.S. Appl. No. 13/652,969.

Office Action dated Dec. 29, 2014 pertaining to U.S. Appl. No. 13/833,793.

Notice of Allowance (Mail Date Mar. 20, 2012) for U.S. Appl. No. 13/117,843, filed May 27, 2011.

Notice of Allowance dated Feb. 2, 2015 pertaining to U.S. Appl. No. 13/795,737.

Office Action dated Feb. 25, 2015 pertaining to U.S. Appl. No. 13/605,481.

Office Action dated Feb. 18, 2015 pertaining to U.S. Appl. No. 13/827,522.

Office Action dated Mar. 19, 2015 pertaining to U.S. Appl. No. 13/795,780.

Office Action dated Jun. 24, 2015 pertaining to U.S. Appl. No. 13/652,969.

Patent Cooperation Treaty, International Preliminary Report on Patentability for PCT/US2013/064512, mail date Apr. 30, 2015, 9 pages.

Patent Cooperation Treaty, International Preliminary Report on Patentability for PCT/US2013/064515, mail date Apr. 30, 2015, 8 pages.

(56) References Cited

OTHER PUBLICATIONS

Corning Gilbert 2004 OEM Coaxial Products Catalog, Quick Disconnects, 2 pages.
Digicon AVL Connector. ARRIS Group Inc. [online] 3 pages. Retrieved from the Internet: <URL: http://www.arrisi.com/special/digiconAVL.asp.
US Office Action, U.S. Appl. No. 10/997,218; Jul. 31, 2006, pp. 1-10.
Society of Cable Telecommunications Engineers, Engineering Committee, Interface Practices Subcommittee; American National Standard; ANSI/SCTE Jan. 2006; Specification for "F" Port, Female, Outdoor. Published Jan. 2006. 9 pages.
The American Society of Mechanical Engineers; "Lock Washers (Inch Series), An American National Standard"; ASME 818.21.1-1999 (Revision of ASME B18.21.1-1994); Reaffirmed 2005. Published Feb. 11, 2000. 28 pages.
U.S. Reexamination Control No. 90/012,300 filed Jun. 29, 2012, regarding U.S. Pat. No. 8,172,612 filed May 27, 2011 (Bence et al.).
U.S. Reexamination Control No. 90/012,749 filed Dec. 21, 2012, regarding U.S. Pat. No. 7,114,990, filed Jan. 25, 2005 (Bence et al.).
U.S. Reexamination Control No. 90/012,835 filed Apr. 11, 2013, regarding U.S. Pat. No. 8,172,612 filed May 27, 2011 (Bence et al.).
Notice of Allowance (Mail Date Mar. 20, 2012) for U.S. Appl. No. 13/117,843.
Search Report dated Jun. 6, 2014 pertaining to International application No. PCT/US2014/023374.
Search Report dated Apr. 9, 2014 pertaining to International application No. PCT/US2014/015934.
Society of Cable Telecommunications Engineers, Engineering Committee, Interface Practices Subcommittee; American National Standard; ANSI/SCTE Feb. 2006; "Specification for "F" Port, Female, Indoor". Published Feb. 2006. 9 pages.
PPC, "Next Generation Compression Connectors," pp. 1-6, Retrieved from http://www.tessco.com/yts/partnearnanufacturer list/vendors/ppc/pdf/ppc digital spread.pdf.
Patent Cooperation Treaty, International Search Report for PCT/US2013/070497, Feb. 11, 2014, 3 pgs.
Patent Cooperation Treaty, International Search Report for PCT/US2013/064515, 10 pgs.
Patent Cooperation Treaty, International Search Report for PCT/US2013/064512, Jan. 21, 2014, 11 pgs.
Huber+Suhner AG, RF Connector Guide: Understanding connector technology, 2007, Retrieved from http://www.ie.itcr.ac.cr/marin/lic/e14515/HUBER+SUENER_RF_Connector_Guide.pdf.
Slade, Paul G,. Electrical Contacts: Principles and Applications, 1999, Retrieved from http://books.google.com/books (table of contents only).
U.S. Reexamination Control No. 95/002,400 filed Sep. 15, 2012, regarding U.S. Pat. No. 8,192,237 filed Feb. 23, 2011 (Purdy et al.).
U.S. Reexamination Control No. 90/013,068 filed Nov. 27, 2013, regarding U.S. Pat. No. 6,558,194 filed Jul. 21, 2000 (Montena).
U.S. Reexamination Control No. 90/013,069 filed Nov. 27, 2013, regarding U.S. Pat. No. 6,848,940 filed Jan. 21, 2003 (Montena).
U.S. *Inter Partes* Review Case No. 2013-00346 filed Jun. 10, 2013, regarding U.S. Pat. No. 8,287,320 filed Dec. 8, 2009, claims 1-8, 10-16, 18-31 (Purdy et al.).
U.S. *Inter Partes* Review Case No. 2013-00343 filed Jun. 10, 2013, regarding U.S. Pat. No. 8,313,353 filed Apr. 30, 2012, claims 1-6 (Purdy et al.).
U.S. *Inter Partes* Review Case No. 2013-00340 filed Jun. 10, 2013, regarding U.S. Pat. No. 8,323,060 filed Jun. 14, claims 1-9 (Purdy et al.).
U.S. *Inter Partes* Review Case No. 2013-00347 filed Jun. 10, 2013, regarding U.S. Pat. No. 8,287,320 filed Dec. 8, 2009, claims 9, 17, 32 (Purdy et al.).
U.S. *Inter Partes* Review Case No. 2013-00345 filed Jun. 10, 2013, regarding U.S. Pat. No. 8,313,353 filed Apr. 30, 2012, claims 7-27 (Purdy et al.).
U.S. *Inter Partes* Review Case No. 2013-00342 filed Jun. 10, 2013, regarding U.S. Pat. No. 8,323,060 filed Jun. 14, 2012, claims 10-25 (Purdy et al.).
U.S. *Inter Partes* Review Case No. 2014-00441 filed Feb. 18, 2014, regarding U.S. Pat. No. 8,562,366 filed Oct. 15, 2012, claims 31,37, 39, 41, 42, 55 56 (Purdy et al.).
U.S. *Inter Partes* Review Case No. 2014-00440 filed Feb. 18, 2014, regarding U.S. Pat. No. 8,597,041 filed Oct. 15, 2012, claims 1, 8, 9, 11, 18-26, 29 (Purdy et al.).
Office Action dated Jun. 12, 2014 pertaining to U.S. Appl. No. 13/795,737.
Office Action dated Aug. 25, 2014 pertaining to U.S. Appl. No. 13/605,481.
Election/Restrictions Requirement dated Jul. 31, 2014 pertaining to U.S. Appl. No. 13/652,969.
Office Action dated Aug. 29, 2014 pertaining to U.S. Appl. No. 13/827,522.
Election/Restrictions Requirement dated Jun. 20, 2014 pertaining to U.S. Appl. No. 13/795,780.
Office Action dated Jun. 24, 2015 pertaining to U.S. Appl. No. 14/259,703.
Office Action dated Jul. 20, 2015 pertaining to U.S. Appl. No. 14/279,870.
Office Action dated Sep. 19, 2014 pertaining to U.S. Appl. No. 13/795,780.
Office Action dated Oct. 6, 2014 pertaining to U.S. Appl. No. 13/732,679.
Corning Cabelcon waterproof CX3 7.0 QuickMount for RG6 cables; Cabelcon Connectors; www.cabelcom.dk; Mar. 15, 2012.
Maury Jr., M.; Microwave Coaxial Connector Technology: A Continuaing Evolution; Maury Microwave Corporation; Dec. 13, 2005; pp. 1-21; Maury Microwave Inc.
"Snap-On/Push-On" SMA Adapter; RF TEC Mfg., Inc.; Mar. 23, 2006; 2 pgs.
RG6 quick mount data sheet; Corning Cabelcon; 2010; 1 pg.; Corning Cabelcon ApS.
RG11 quick mount data sheet; Corning Cabelcon; 2013; 1 pg.; Corning Cabelcon ApS.
Gilbert Engineering Co., Inc.; OEM Coaxial Connectors catalog; Aug. 1993; p. 26.
UltraEase Compression Connectors; "F" Series 59 and 6 Connectors Product Information; May 2005; 4 pgs.
Pomona Electronics Full Line Catelog; vol. 50; 2003; pp. 1-100.
Office Action dated Feb. 2, 2016 pertaining to U.S. Appl. No. 14/259,703.
Office Action dated Oct. 7, 2015 pertaining to U.S. Appl. No. 13/927,537.
Search Report dated Oct. 7, 2014 pertaining to International application No. PCT/US2014/043311.
Report on the Filing or Determination of an Action Regarding a Patent or Trademark regarding U.S. Pat. No. 8,313,353; U.S. Pat. No. 8,313,345; U.S. Pat. No. 8,323,060—Eastern District of Arkansas.
Report on the Filing or Determination of an Action Regarding a Patent or Trademark regarding U.S. Pat. No. 8,192,237; U.S. Pat. No. 8,287,320; U.S. Pat. No. 8,313,353; U.S. Pat. No. 8,323,060—Northern District of New York.
Report on the Filing or Determination of an Action Regarding a Patent or Trademark regarding U.S. Pat. No. 8,562,366—Northern District of New York.
Office Action dated May 3, 2016 pertaining to U.S. Appl. No. 14/750,435.
Petition for Inter Partes Review of U.S. Pat. No. 8,075,338, Case No. IPR2016-01569, filed Aug. 9, 2016.
Declaration of Ronald Locati filed in IPR2016-01569 on Aug. 9, 2016.
Preliminary Patent Owner Response filed in IPR2016-01659 dated Nov. 17, 2016.
Declaration of Charles A. Eldering, Ph.D. filed in IPR2016-01659 on Nov. 17, 2016.
Petition for Inter Partes Review of U.S. Pat. No. 8,075,338, Case No. IPR2016-01573, filed Aug. 9, 2016.

(56) References Cited

OTHER PUBLICATIONS

Declaration of Ronald Locati filed in IPR2016-01573 on Aug. 9, 2016.
Preliminary Patent Owner Response filed in IPR2016-01573 on Nov. 17, 2016.
Declaration of Charles A. Eldering, Ph.D. filed in IPR2016-01573 on Nov. 17, 2016.
Petition for Inter Partes Review of U.S. Pat. No. 8,366,481, Case No. IPR2016-01570, filed Aug. 9, 2016.
Declaration of Ronald Locati filed in IPR2016-01570 on Aug. 9, 2016.
Preliminary Patent Owner Response filed in IPR2016-01570 on Nov. 17, 2016.
Declaration of Charles A. Eldering, Ph.D. filed in IPR2016-01570 on Nov. 17, 2016.
Petition for Inter Partes Review of U.S. Pat. No. 8,366,481, Case No. IPR2016-01572, filed Aug. 9, 2016.
Declaration of Ronald Locati filed in IPR2016-01572 on Aug. 9, 2016.
Preliminary Patent Owner Response filed in IPR2016-01572 on Nov. 17, 2016.
Declaration of Charles A. Eldering, Ph.D. filed in IPR2016-01572 on Nov. 17, 2016.
Definition of "on" from The American Heritage College Dictionary 953 (3rd ed. 1997) (IPR2016-01569, Exhibit 1030).
Patents, PPC Broadband, Inc., available at http://www.ppc-online.com/Patents/index.cfm, downloaded on Aug. 4, 2016 (IPR2016-01569, Exhibit 1033).
Corning Opening Claim Construction Brief (Civil Action No. 5:16-cv-00162-GLS-DEP) (IPR2016-01569, Exhibit 2001).
Office Action Response filed in U.S. Appl. No. 13/652,969 on Apr. 20, 2015 (IPR2016-01569, Exhibit 2007).
Office Action in U.S. Appl. No. 13/693,095 dated Feb. 28, 2014 (IPR2016-01569, Exhibit 2021).
Office Action Response filed in U.S. Appl. No. 13/693,095 on Jun. 27, 2014 (IPR2016-01569, Exhibit 2022).
Notice of Allowance in U.S. Appl. No. 13/693,095 dated Aug. 4, 2014 (IPR2016-01569, Exhibit 2023).
Office Action Response filed in U.S. Appl. No. 13/693,095 on Apr. 16, 2015 (IPR2016-01569, Exhibit 2025).
Notice of Allowance in U.S. Appl. No. 13/833,793 dated Jul. 8, 2014 (IPR2016-01569, Exhibit 2026).
Office Action Response filed in U.S. Appl. No. 14/259,703 on Apr. 29, 2016 (IPR2016-01569, Exhibit 2029).
U.S. Appl. No. 61/323,597, filed Apr. 13, 2010 ("Burris Provisional") (IPR2016-01570, Exhibit 1004).
Complaint filed in *PPC Broadband, Inc.* v. *Corning Optical Communications RF, LLC.*, 5:16-00162 (N.D.N.Y.) dated Feb. 11, 2016 (IPR2016-01570, Exhibit 1012).
Office Action in U.S. Appl. No. 13/075,406 dated Aug. 6, 2012 (IPR2016-01570, Exhibit 1016).
Office Action Response filed in U.S. Appl. No. 13/075,406 on Nov. 2, 2012 (IPR2016-01570, Exhibit 1020).
Notice of Allowance with Examiner's Reasons for Allowance in U.S. Appl. No. 13/075,406 dated Nov. 27, 2012 (IPR2016-01570, Exhibit 1021).
Apple Rubber Products Seal Design Guide 75 (Mary K. Chaffee et al. eds.) (2009), available at http://www.applerubber.com/src/pdf/seal-design-guide.pcif (IPR2016-01570, Exhibit 1022).
Declaration Under 37 C.F.R. 1.131 filed in U.S. Appl. No. 13/913,043 on Jan. 7, 2016 (IPR2016-01570, Exhibit 1025).
U.S. Appl. No. 13/084,099, filed Apr. 11, 2011 ("Burris Application") (IPR2016-01570, Exhibit 1026).
Supplemental Reply to the Final Office Action and Advisory Action, filed in U.S. Appl. No. 13/084,099 on Feb. 19, 2014 (IPR2016-01570, Exhibit 1028).
Notice of Allowance in U.S. Appl. No. 13/084,099 dated Mar. 14, 2014 (IPR2016-01570, Exhibit 1029).
Notice of Allowance with Examiner's Amendment in U.S. Appl. No. 13/084,099 dated Apr. 13, 2015 (IPR2016-01570, Exhibit 1032 ).
Notice of Allowance in U.S. Appl. No. 13/084,099 dated Oct. 27, 2014 (IPR2016-01570, Exhibit 1033).
Notice of Allowance with Examiner's Amendment in U.S. Appl. No. 13/084,099 dated Aug. 21, 2014 (IPR2016-01570, Exhibit 1034).
Notice of Allowance with Examiner's Reasons for Allowance in U.S. Appl. No. 13/913,043 dated Jul. 20, 2016 (IPR2016-01570, Exhibit 1036).
Jerry Whitlock et al., The Seal Man's O-Ring Handbook (Eric Jackson ed., EPM, Inc. 1st ed. 2004), available at https://www.physics.harvard.edu/uploads/files/machineshop/epm_oring_handbook.pdf (IPR2016-01570, Exhibit 1037).
O-Ring Identification Chart, Universal Air Conditioner, Inc., available at https://www.uacparts.com/Downloads/UAC%20Oring%20Chart.Pdf (IPR2016-01570, Exhibit 1040).
Corning Opening Claim Construction Brief (Civil Action No. 5:16-cv-00162-GLS-DEP) (IPR2016-01570, Exhibit 2001).
Mar. 6, 2014 Locati Reexam Declaration (95/002,400) (IPR2016-01570, Exhibit 2002).
Mar. 6, 2014 Corning TPR Reexam Comments (95/002,400) (IPR2016-01570, Exhibit 2003).
Japanese Patent Document No. 2002-15823 ("Tatsuzuki") (IPR2016-01570, Exhibit 2005).
Japanese Patent Document No. 2002-15823 ("Tatsuzuki") (Translation) (IPR2016-01570, Exhibit 2006).
Office Action in U.S. Appl. No. 13/084,099 dated Nov. 29, 2013 (IPR2016-01570, Exhibit 2021).
Office Action Response filed in U.S. Appl. No. 13/084,099 on Jan. 20, 2014 (IPR2016-01570, Exhibit 2022).
Office Action Response filed in U.S. Appl. No. 13/084,099 on Feb. 19, 2014 (IPR2016-01570, Exhibit 2023).
Certified English Translation of Japanese Publication No. JP2000-40564 ("JP '564") (IPR2016-01569, Exhibit 1007).
Japanese Publication No. JP2000-40564 (IPR2016-01569 Exhibit 1008.
Office Action Response filed in U.S. Appl. No. 12/906,503 dated Aug. 31, 2011 (IPR2016-01569, Exhibit 1014).
Notice of Allowance in U.S. Appl. No. 12/906,503 dated Oct. 18, 2011 (IPR2016-01569, Exhibit 1015).
Definition of "near" from the American Heritage College Dictionary 910 (3rd ed. 1997) (IPR2016-01569, Exhibit 1016).
Definition of "proximate" from The American Heritage College Dictionary 1102 (3rd ed. 1997) (IPR2016-01569, Exhibit 1017).
[Redacted] Drawing of a connector (NS-12045) accused of infringement in the Complaint by Patent Owner in the related litigation, *PPC Broadband, Inc.* v. *Corning Optical Communications RF, LLC.*, 5:16-00162 (N.D.N.Y.) (IPR2016-01569, Exhibit 1018).
*Machinery's Handbook: A Reference Book for the Mechanical Engineer, Draftsman, Toolmaker and Machinist*, Erik Oberg and Franklin D. Jones, pp. 494, 497 (19th ed. 1973) (IPR2016-01569, Exhibit 1020).
*Cantilever Beams Part 1—Beam Stiffness*, Technical Tidbits, Issue No. 20 (Brush Wellman Inc. 2010) (IPR2016-01569, Exhibit 1021).
*Cantilever Beams Part 2—Analysis*, Technical Tidbits, Issue No. 21 (Brush Wellman Inc. 2010) (IPR2016-01569, Exhibit 1022).
Paul A. Tipler. *Physics: For Scientists and Engineers*. 3rd ed., 1991, vol. 1. Worth Publishers: New York, NY, pp. 90-91 (IPR2016-01569, Exhibit 1024).
Definition of "Resilient" from The Random House College Dictionary 1123 (Revised ed. 1980) (IPR2016-01569, Exhibit 1025).
Definition of "Resilient" downloaded from http://www.dictionary.com/browse/resilient on Jul. 28, 2016 (IPR2016-01569, Exhibit 1026).
International Search Report and Written Opinion PCT/US2006/002042 dated May 9, 2006, 18 pgs.
U.S. Office Action for U.S. Appl. No. 10/997,218 dated Jul. 31, 2006, 10 Pgs.

* cited by examiner

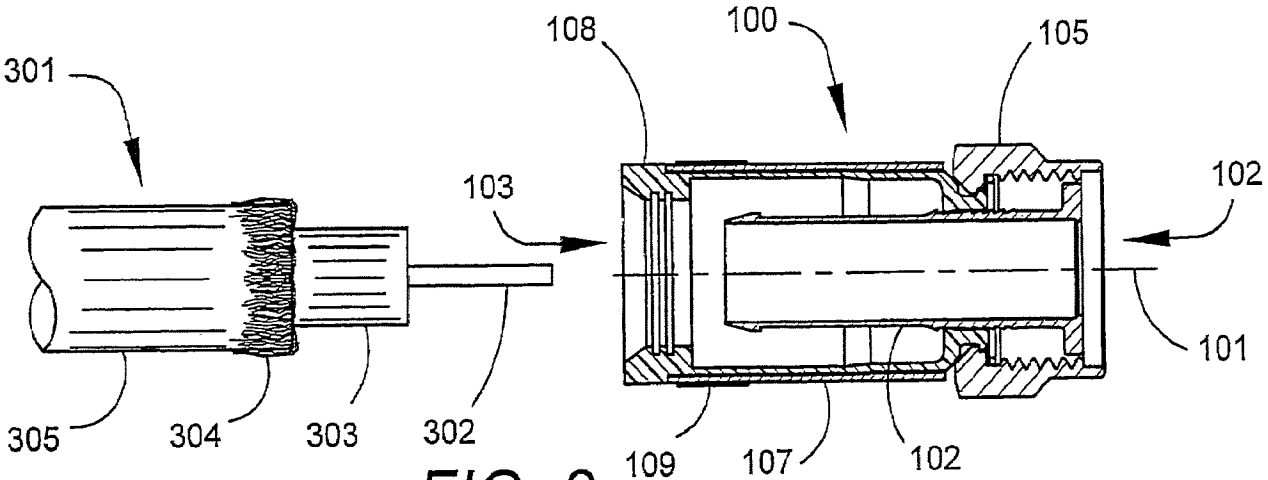
FIG. 3
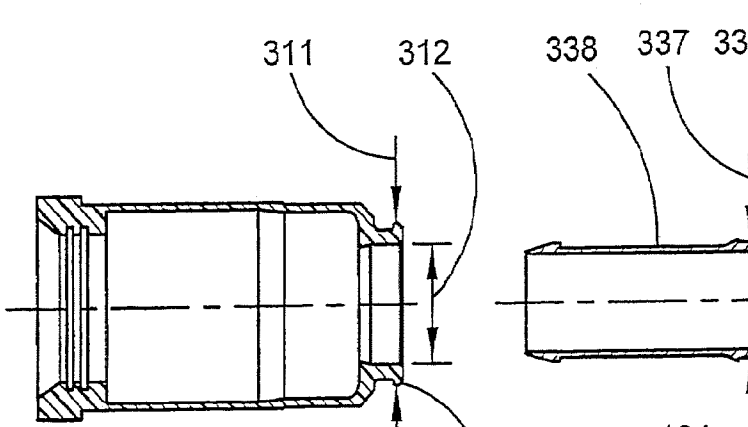
FIG. 3A
FIG. 3B
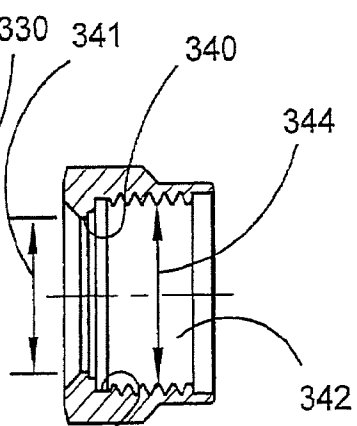
FIG. 3C

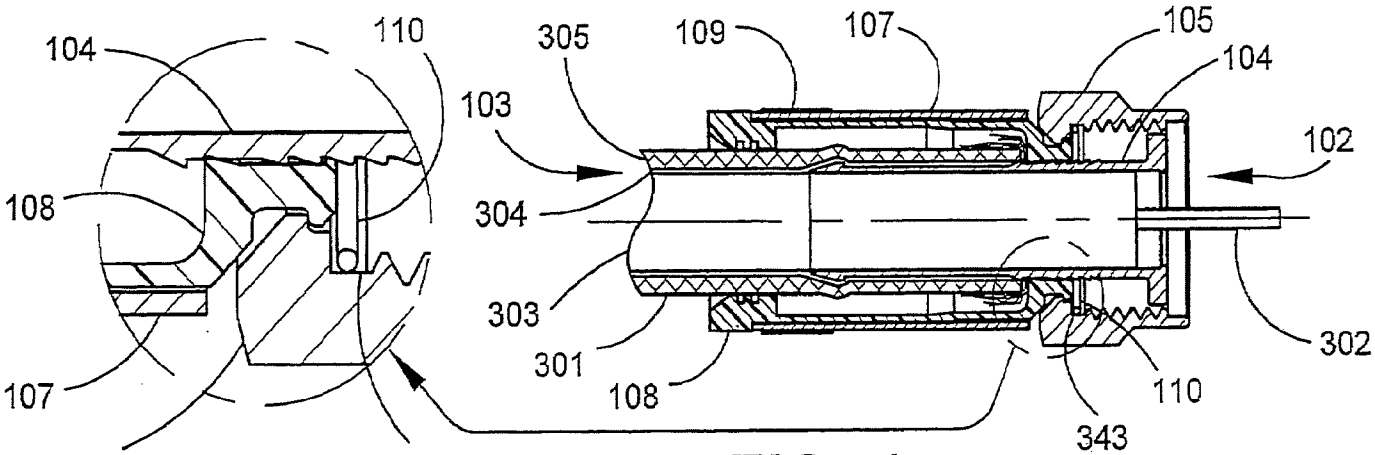
FIG. 4
FIG. 4A
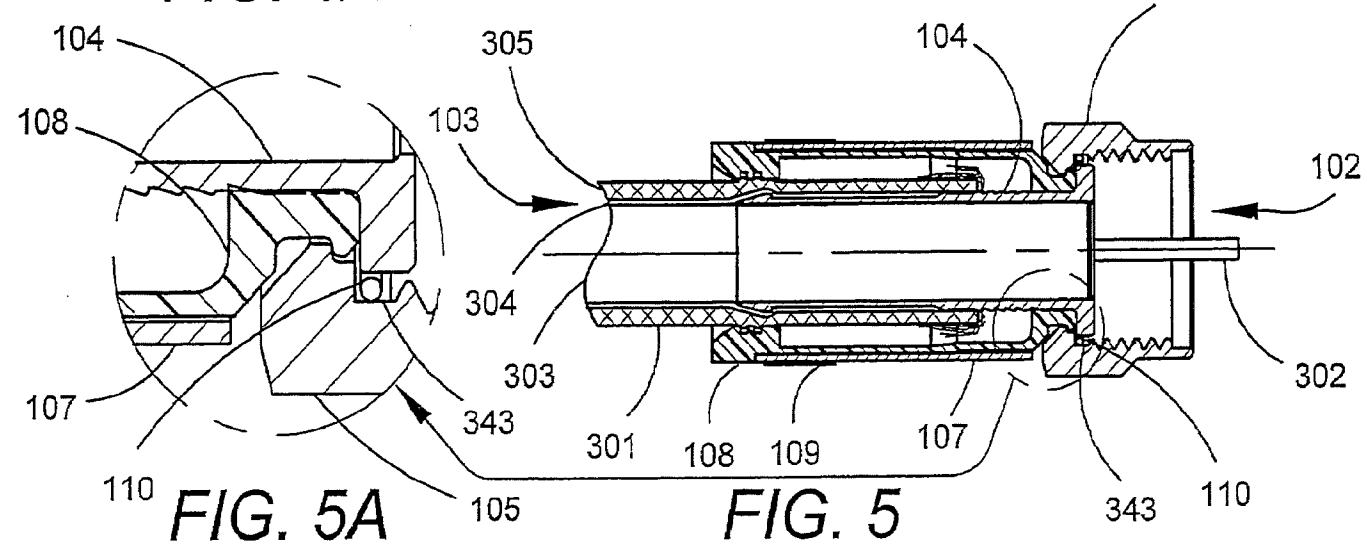
FIG. 5
FIG. 5A

ELECTRICAL CONNECTOR WITH GROUNDING MEMBER

This application is a continuation of U.S. patent application Ser. No. 13/438,532, filed Apr. 3, 2012, which is a continuation of U.S. patent application Ser. No. 13/117,843 filed on May 27, 2011, now U.S. Pat. No. 8,172,612, which is a continuation of U.S. patent application Ser. No. 12/332,925 filed on Dec. 11, 2008, now U.S. Pat. No. 7,955,126, which is a continuation of U.S. patent application Ser. No. 11/541,903 filed on Oct. 2, 2006, now U.S. Pat. No. 7,479,035, which is a continuation of U.S. patent application Ser. No. 11/043,844 filed on Jan. 25, 2005, now U.S. Pat. No. 7,114,990, the contents of which are relied upon and incorporated by reference in their entirety.

BACKGROUND OF THE INVENTION

1. Field of the Invention

This invention relates generally to electrical connectors, and more particularly to coaxial cable connectors capable of being connected to a terminal.

2. Description of the Related Art

Coaxial cable connectors, such as type F connectors, are used to attach coaxial cable to another object or appliance, e.g., a television set or VCR having a terminal adapted to engage the connector. The terminal of the appliance includes an inner conductor and a surrounding outer conductor, Coaxial cable includes a center conductor for transmitting a signal. The center conductor is surrounded by a dielectric material, and the dielectric material is surrounded by an outer conductor; this outer conductor may be in the form of a conductive foil and/or braided sheath. The outer conductor is typically maintained at ground potential to shield the signal transmitted by the center conductor from stray noise, and to maintain a continuous desired impedance over the signal path. The outer conductor is usually surrounded by a plastic cable jacket that by the center conductor from stray noise, and to maintain a continuous desired impedance over the signal path. The outer conductor is usually surrounded by a plastic cable jacket that electrically insulates, and mechanically protects, the outer conductor. Prior to installing a coaxial connector onto an end of the coaxial cable, the end of the coaxial cable is typically prepared by stripping off the end portion of the jacket to bare the end portion of the outer conductor. Similarly, it is common to strip off a portion of the dielectric to expose the end portion of the center conductor.

Coaxial cable connectors of the type known in the trade as "F connectors" often include a tubular post designed to slide over the dielectric material, and under the outer conductor of the coaxial cable, at the prepared end of the coaxial cable. If the outer conductor of the cable includes a braided sheath, then the exposed braided sheath is usually folded back over the cable jacket. The cable jacket and folded-back outer conductor extend generally around the outside of the tubular post and are typically received in an outer body of the connector; this outer body of the connector is usually fixedly secured to the tubular post. A coupler is rotatably secured around the tubular post and includes an internally-threaded region for engaging external threads formed on the outer conductor of the appliance terminal.

When connecting the end of a coaxial cable to a terminal of a television set, equipment box, or other appliance, it is important to achieve a reliable electrical connection between the outer conductor of the coaxial cable and the outer conductor of the appliance terminal. This goal is usually achieved by ensuring that the coupler of the connector is fully tightened over the connection port of the appliance. When fully tightened, the head of the tubular post of the connector directly engages the edge of the outer conductor of the appliance port, thereby making a direct electrical ground connection between the outer conductor of the appliance port and the tubular post; in turn, the tubular post is engaged with the outer conductor of the coaxial cable.

However, in many cases, it is difficult for an installer to reach the connection ports of the appliance with a wrench, and in some instances, it is even difficult for the installer to reach such connection ports with his or her fingers. As a result, it can often happen that typo F connectors are not fully tightened to the appliance port. In such a loose connection system, wherein the coupler of the coaxial connector is not drawn tightly to the appliance port connector, a gap exists between the outer conductor of the appliance port and the tubular post of the connector. Unless an alternate ground path exists, poor signal quality, and RFI leakage, will result.

As mentioned above, the coupler is rotatably secured about the head of the tubular post. The head of the tubular post usually includes an enlarged shoulder, and the coupler typically includes an inwardly-directed flange for extending over and around the shoulder of the tubular post. In order not to interfere with free rotation of the coupler, manufacturers of such F-style connectors routinely make the outer diameter of the shoulder (at the head of the tubular post) of smaller dimension than the inner diameter of the central bore of the coupler. Likewise, manufacturers routinely make the inner diameter of the inwardly-directed flange of the coupler of larger dimension than the outer diameter of the non-shoulder portion of the tubular post, again to avoid interference with rotation of the coupler relative to the tubular post. In a loose connection system, wherein the coupler of the coaxial connector is not drawn tightly to the appliance port connector, an alternate ground path may fortuitously result from contact between the coupler and the tubular post, particularly if the coupler is not centered over, and axially aligned with, the tubular post. However, this alternate ground path is not stable, and can be disrupted as a result of vibrations, movement of the appliance, movement of the cable, or the like.

Alternatively, there are some cases in which such an alternate ground path is provided by fortuitous contact between the coupler and the outer body of the coaxial connector, provided that the outer body is formed from conductive material. This alternate ground path is similarly unstable, and may be interrupted by relative movement between the appliance and the cable, or by vibrations. Moreover, this alternate ground path does not exist at all if the outer body of the coaxial connector is constructed of non-conductive material. Such unstable ground paths can give the to intermittent failures that are costly and time-consuming to diagnose.

OBJECTS OF THE INVENTION

It is therefore an object of the present invention to provide a coaxial cable connector for connecting a coaxial cable to a connection port of an appliance, the coaxial cable connector being of the type that includes a tubular post and a coupler, such as a rotatable coupler, which ensures a reliable ground connection between the tubular post of the connector and an outer conductor of the appliance port, even if the coupler is not fully tightened onto the appliance port.

It is another object of the present invention to provide such a coaxial cable connector which maintains a reliable ground path between the coupler and the tubular post, at least following installation of such connector onto the end of a coaxial cable.

It is still another object of the present invention to provide such a coaxial connector that can be manufactured economically.

These and other objects of the present invention will become more apparent to those skilled in the art as the description thereof proceeds.

SUMMARY OF THE INVENTION

Briefly described, the present invention relates to a coaxial cable connector comprising a tubular post, a coupler and a grounding means for providing an electrically conductive path between the post and the coupler. In accordance with a preferred embodiment thereof, the present invention relates to a coaxial cable connector for coupling a prepared end of a coaxial cable to a threaded female equipment port, and including a tubular post having a first end adapted to be inserted into the prepared end of the coaxial cable between the dielectric material and the outer conductor thereof. A coupler is rotatably secured over the second end of the tubular post, and includes a central bore, at least a portion of which is threaded for engaging the female equipment port. An outer body is secured to the tubular post and extends about the first end of the tubular post for receiving the outer conductor, and preferably the cable jacket, of the coaxial cable.

In a preferred embodiment of the present invention, a resilient, electrically-conductive grounding member is disposed between the tubular post and the coupler. This grounding member engages both the tubular post and the coupler for providing an electrically-conductive path therebetween, but without restricting rotation of the coupler relative to the tubular post.

For some preferred embodiments, the grounding member is generally arcuately shaped to extend around the tubular post over an arc of at least 225°, and may extend for a full 360°. This arcuately shaped grounding member may be in the form of a generally circular broken ring, or C-shaped member, as by bending a strip of metal wire into an arc. Preferably, the grounding member has a shape that is out-of-round, and more preferably oblong, rather than circular, in order to ensure reliable electrical contact with both the coupler and the tubular post. In order to retain the grounding member inside the coupler, the inner bore of the coupler may include an annular recess proximate to the end of the coupler that encircles the tubular post; at least portions of the grounding member are engaged with the annular recess to prevent the grounding member from being axially displaced within the coupler.

As mentioned above, the tubular post may include an enlarged shoulder at the head thereof. In one preferred embodiment of the present invention, the grounding member surrounds the enlarged shoulder of the tubular post, at least when the coaxial cable connector is assembled onto the prepared end of a coaxial cable, whereby at least portions of the grounding member engage the outer surface of such enlarged shoulder.

In one embodiment of the present invention, the grounding member is generally circular and includes a plurality of projections extending outwardly therefrom for engaging the coupler. In another embodiment of the present invention, the grounding member is generally circular and includes a plurality of projections extending inwardly therefrom for engaging the tubular post.

In yet another embodiment of the present invention, the tubular post includes an enlarged shoulder extending inside the coupler, and including a first radial face that faces the opposite end of the tubular post. The coupler includes a flange directed inwardly toward the tubular post; this inwardly directed flange including a second radial face that faces toward the connection port of the appliance to which the coaxial cable is to be connected. The grounding member is disposed between the first radial face and the second radial face. In this embodiment, the grounding member is resilient relative to the longitudinal axis of the connector, and is compressed between the first radial face and the second radial face to maintain sliding electrical contact between the shoulder of the tubular post (via its first radial face) and the flange of the coupler (via its second radial face).

The coaxial connector of the present invention may also include a sealing ring seated within the coupler for rotatably engaging the body member to form a seal therebetween.

In an alternate embodiment of the present invention, conductive grease is substituted for a discrete grounding member. In this embodiment, an outer dimension of a portion of the tubular post is caused to be commensurate with an inner dimension of an adjacent portion of the coupler. While the gap between such adjacent portions, coupled with the lubrication provided by the conductive grease, is sufficient to permit rotation of the coupler relative to the tubular post, the conductive grease nonetheless functions to maintain reliable electrical coupling across such gap.

BRIEF DESCRIPTION OF THE DRAWINGS

The present invention will be described with greater specificity and clarity with reference to the following drawings, in which:

FIG. 3 is a cross-sectional view of the F connector of FIG. 1 through cut-line 3-3, and a side view of a prepared coaxial cable ready to be inserted into a back end of the F connector;

FIG. 3A is a cross-sectional view of the body of the F connector of FIG. 1 through cut-line 3-3;

FIG. 3B is a cross-sectional view of a tubular post of the F connector of FIG. 1, through cut-line 3-3;

FIG. 3C is a cross-sectional view of the coupling nut of the F connector of FIG. 1 through cut-line 3-3;

FIG. 4 is a cross-sectional view of the F connector of FIG. 1 through cut-line 3-3, and cross-sectional view of the prepared coaxial cable fully inserted into the back end thereof, prior to axial compression of the F connector;

FIG. 4A is an enlargement of a portion of FIG. 4;

FIG. 5 is a cross-sectional view of the F connector of FIG. 1 through cut-line 3-3, and a cross-sectional view of the prepared coaxial cable fully inserted into the back end thereof, subsequent to axial compression of the F connector;

FIG. 5A is an enlargement of a portion of FIG. 5;

Figures 1, 2, 2A:
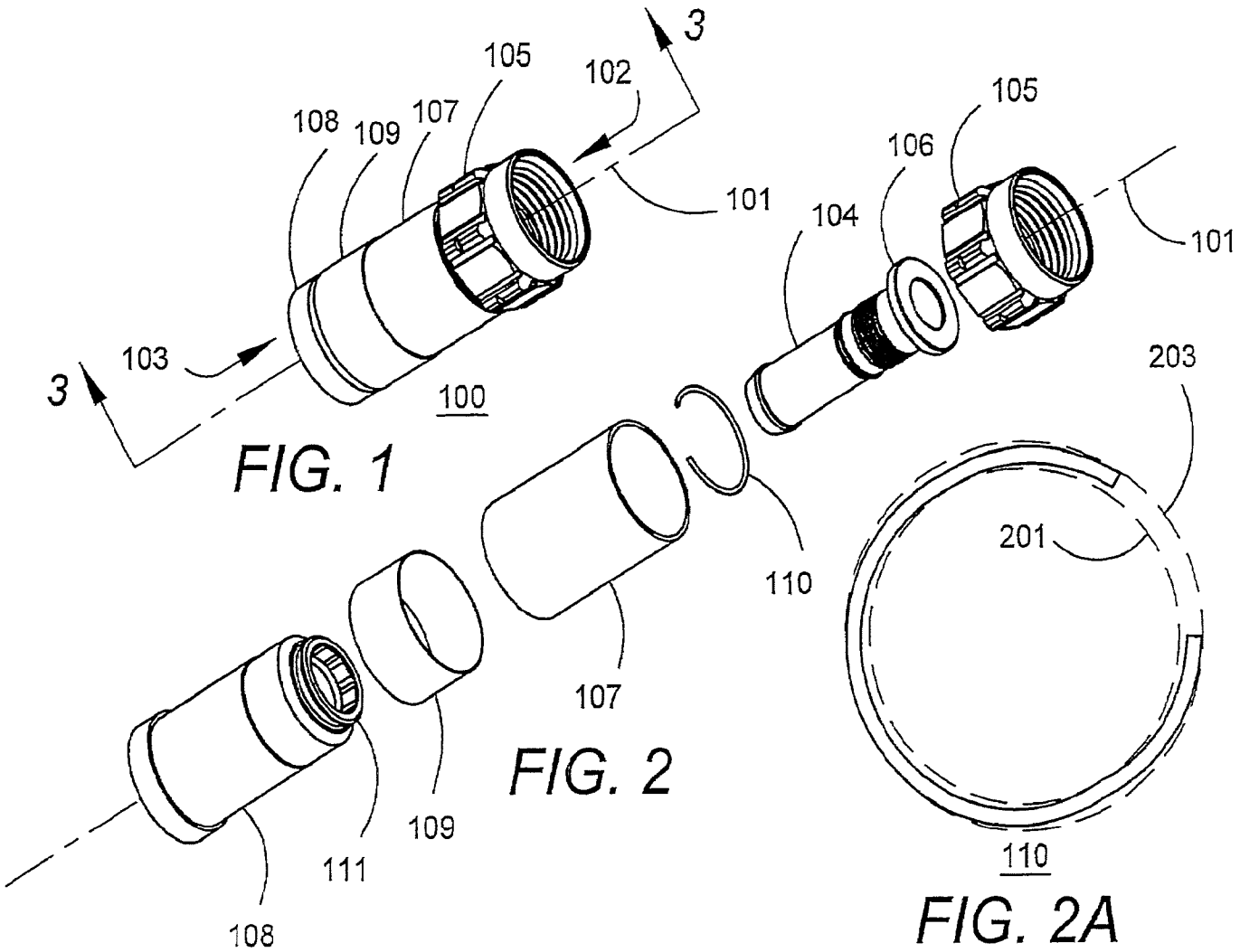
FIG. 1 is a perspective view of an F connector in accordance with the preferred embodiment of the invention, including a body and a coupling nut.
FIG. 2 is an exploded view of the F connector of FIG. 1, including a preferred embodiment of a grounding member.
FIG. 2A is an enlarged plan view of the preferred embodiment of the grounding member of FIG. 2.

For simplicity and clarity of illustration, the drawing figures illustrate the general manner of construction, and descriptions and details of well-known features and techniques are omitted to avoid unnecessarily obscuring the invention. Furthermore, elements in the drawing figures are not necessarily drawn to scale.

DESCRIPTION OF THE PREFERRED EMBODIMENT

FIG. 1 is a perspective view of an F connector 100 in accordance with the preferred embodiment of the invention. The F connector 100 (hereinafter, "connector") has a longitudinal axis 101. The connector has a front end 102 and a back end 103.

FIG. 2 is an exploded view of the connector 100. The connector 100 includes tubular post 104, a coupling nut 105 rotatably secured over an end 106 of the tubular post for securing the connector to an appliance (not shown), and a body 108 secured to the tubular post. A shell 107 and a label 109 are secured to the body 108. Preferably, the body 108 is made entirely of acetal plastic. Alternatively, the body 108 is made of brass, plated with nickel. The shell 107 acids strength to the plastic body 108 and protects the plastic body from ultraviolet light. The tubular post 104 is preferably metallic, and more preferably, made of brass, with a tin plating; as tin is more conductive than nickel. The coupling nut 105 is preferably metallic, and more preferably, formed from brass, plated with nickel or with another non-corrosive material.

In the embodiment shown in the drawings, the coupling nut 105 is rotatably secured over an end 106 of the tubular post 104 via a neck 111 of the body 108. Advantageously, an electrical grounding path is constantly maintained between the coupling nut 105 and the tubular post 104, including, in particular, when the coupling nut 105 of the connector 100 is not tightly fastened to the appliance. The electrical grounding path is provided by a resilient, electrically-conductive grounding member 110 disposed between the tubular post 104 and the coupling nut 105.

FIG. 2A is an enlarged plan view of the preferred embodiment of the grounding member 110. In the preferred embodiment of the present invention, the electrically-conductive grounding member 110 is disposed between the tubular post 104 and the coupling nut 105. The grounding member 110 contacts both the tubular post 104 and the coupling nut 105 for providing an electrically-conductive path therebetween, but without restricting rotation of the coupling nut relative to the tubular post. A preferred embodiment of the grounding member 110 shown in FIG. 2A is a spring member, or circlip, disposed between the coupling nut 105 and the tubular post 104, which establishes a stable ground path between the coupling nut and the post, and which is preferably constructed of a wire-type material. The grounding member 110 is retained in the coupling nut 105 by an annular recess 343 (see FIG. 3C) in the coupling nut. The spring action of the grounding member 110 serves to form a ground path from the coupling nut 105 to the tubular post 104 while allowing the coupling nut 105 to rotate. The grounding member 110 is resilient and is generally arcuately shaped. The grounding member 110 extends around the tubular post 104 over an arc of at least 225°, and may extend for a full 360°. The arcuately shaped grounding member 110 may be in the form of a generally circular broken ring, or C-shaped member, as by bending a strip of metal wire into an arc. Preferably, the grounding member 110 is a C-shaped metal clip that has an arcuate curvature that is non-circular. The grounding member 110 has a minimum diameter 201 and a maximum diameter 203. Preferably, the grounding member 110 is made of stainless steel wire that has a wire diameter of between 0.010-inch and 0.020-inch; in a preferred embodiment, the wire diameter is about 0.016-inch. Stainless steel is a preferred metal for the grounding member 110 because it need not be plated for corrosion resistance.

FIG. 3 is a cross-sectional view of the connector 100 through cut-line 3-3 of FIG. 1, and a side view of a prepared coaxial cable 301 ready to be inserted into a back end 103 of the connector. The center conductor 302 of the coaxial cable 301 is surrounded by a dielectric material 303, and the dielectric material is surrounded by an outer conductor 304 that may be in the form of a conductive foil and/or braided sheath. The outer conductor 304 is usually surrounded by a plastic cable jacket 305 that electrically insulates, and mechanically protects, the outer conductor.

FIG. 3A is a cross-sectional view of the body 108 of FIG. 1 through cut-line 3-3. FIG. 3B is a cross-sectional view of the tubular post 104 of FIG. 1 through cut-line 3-3. FIG. 3C is a cross-sectional view of the coupling nut 105 of FIG. 1 through cut-line 3-3. Referring now to FIGS. 3, 3A, 3B and 3C, the body 108 has a lip 310 at a front end of the body. The lip 310 has an outer diameter 311 and an inner diameter 312. The coupling nut 105 is rotatably secured about a head 330 at the front end of the tubular post 104. The head 330 of the tubular post 104 usually includes an enlarged shoulder 332. The coupling nut 105 typically includes an inwardly-directed flange 340 that extends over and around the shoulder 332 of the tubular post 104. In order to retain the grounding member 110 inside the coupling nut 105, the inner, or central, bore 342 of the coupling nut 105 may include an annular recess 343 that is proximate to the end of the coupling nut that encircles the tubular post 104. At least portions of the grounding member 110 are engaged with the annular recess 343 to prevent the grounding member from being axially displaced within the coupling nut 105. The tubular post 104 may include an enlarged shoulder 332 at the head 330 thereof. The shoulder 332 has a first radial face 333 that faces the back end of the tubular post 104. In one preferred embodiment of the present invention, the grounding member 110 surrounds the enlarged shoulder 332 of the tubular post 104, at least when the connector 100 is assembled onto the prepared end of a coaxial cable 301. At least portions of the grounding member 110 contact the outer surface 334 of such enlarged shoulder 332.

The coupling nut 105 has an inwardly-directed flange near the back end of the coupling nut. The coupling nut 105 has an inner diameter 341 at a back end of the coupling nut. In order to retain the buck end of the coupling nut 105 on the front end of the body 108, the inner diameter 341 of the coupling nut has a dimension less than the outer diameter of the lip 310 of the body 108. In order not to interfere with free rotation of the coupling nut 105, the outer diameter 336 of the shoulder 332 (at the head 330 of the tubular post 104) is of smaller dimension than the inner diameter 344 of the central bore of the coupling nut 105. Likewise, the inner diameter 341 of the inwardly-directed flange 340 of the coupling nut 105 is of larger dimension than the outer diameter 337 of the non-shoulder portion 338 of the tubular post 104, again to avoid interference with rotation of the coupling nut 105 relative to the tubular post.

FIG. 4 is a cross-sectional view of the connector 100 through cut-line 3-3, and cross-sectional view of the prepared coaxial cable 301 fully inserted into the back end 103 thereof, prior to axial compression of the connector. FIG. 4A is an enlargement of a portion of FIG. 4. Referring now to FIGS. 4 and 4A, the resilient, electrically-conductive grounding member 110 is shown disposed between the tubular post 104 and the coupling nut 105. The grounding member 110 is disposed in the annular recess 343 that encircles the tubular post 104.

FIG. 5 is a cross-sectional view of the connector 100 through cut-line 3-3, and a cross-sectional view of the prepared coaxial cable 301 fully inserted into the back end 103 thereof, subsequent to axial compression of the connector. FIG. 5A is an enlargement of a portion of FIG. 5. Referring now to FIGS. 5 and 5A, as a result of axial compression by a standard compression tool (not shown), the tubular post 104 slides (to the right in the drawings) relative to the other components of the connector 100 and relative to the cable 301, such that the shoulder 332 of the tubular post is radially inward of the grounding member 110. At least a portion of the grounding member 110 engages the coupling nut 105 at the annular recess 343 of the coupling nut, and at least another portion of the grounding member engages tubular post 104 at the shoulder 332 of the tubular post. The tubular post 104 is in electrical contact with the outer conductor 304 of the cable 301 along the back portion of the tubular post, and the coupling nut 105 may engage the outer conductor of an appliance port (not shown). Therefore, when the connector 100 is fastened to an appliance port, there is maintained an electrical grounding path between the outer conductor 304 of the cable 301 and the outer conductor of the appliance port, whether or not the coupling nut 105 of the connector is tightly fastened to the appliance port.

Figure 6:
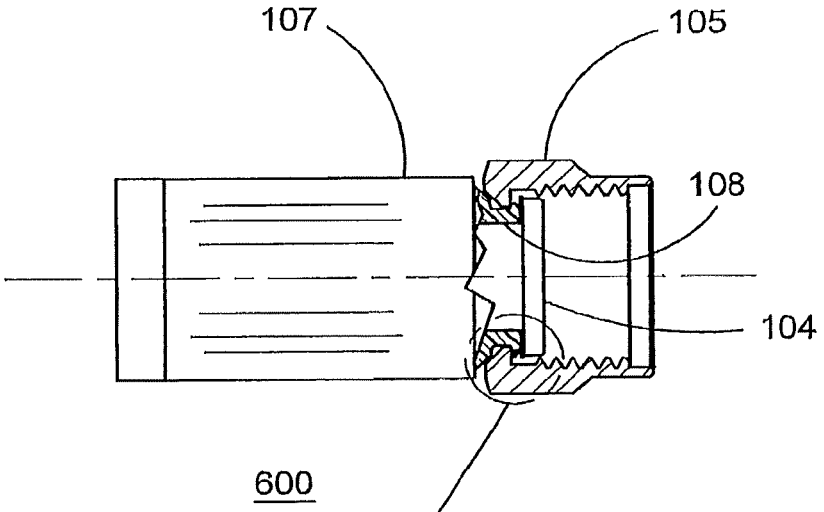
FIG. 6 is a partial cross-sectional view of a first alternate embodiment of an F connector having a first alternate grounding member.
Figure 6A:
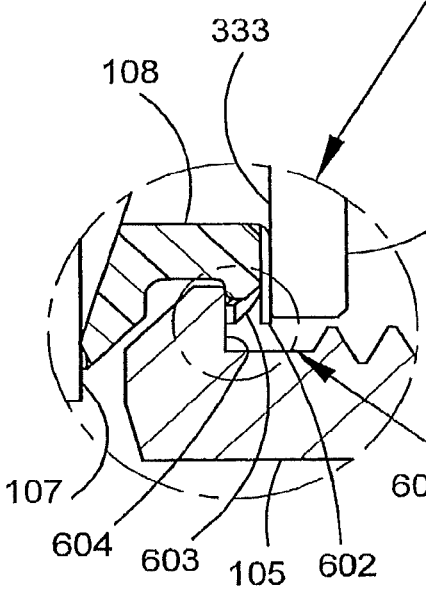
FIG. 6A is an enlargement of a portion of FIG. 6.
Figure 6B:
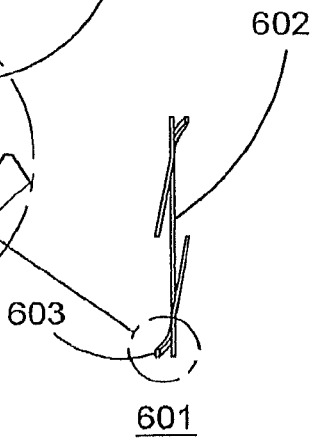
FIG. 6B is a slightly enlarged side view of the first alternate grounding member of FIG.6.
Figure 6C:
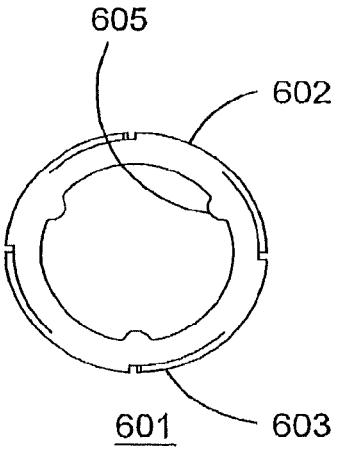
FIG. 6C is a slightly enlarged plan view of the first alternate grounding member of FIG. 6.

FIG. 6 is a partial cross-sectional view of a first alternate embodiment of a connector 600 having a first alternate grounding member 601 (see FIGS. 6A-6C), shown subsequent to axial compression. FIG. 6A is an enlargement of a portion of the first alternate embodiment of the connector 600 showing a portion of the first alternate grounding member 601. FIG. 6B is a slightly enlarged side view of the first alternate grounding member 601. FIG. 6C is a slightly enlarged plan view of the first alternate grounding member 601. Referring now to FIGS. 6, 6A, 6B and 6C, the first alternate grounding member 601 is a spring finger grounding member retained between the coupling nut 105 and the tubular post 104. The first alternate grounding member 601 is constructed of a thin cross section of material such beryllium copper. The first alternate grounding member 601 comprises a ring portion 602 and a plurality of fingers 603 that project at approximately a 30° angle from the plane of the ring. The spring action of the fingers 603 extend to, and make contact with, a radial surface 604 near the back end of the coupling nut 105 that faces the front end of the coupling nut, which serve to connect a ground path from the coupling nut to the tubular post while allowing the coupling nut to rotate. The first alternate grounding member 601 has optional internal lugs 605 that contact the outer diameter 337 of the non-shoulder portion of the tubular post.

Figure 7:
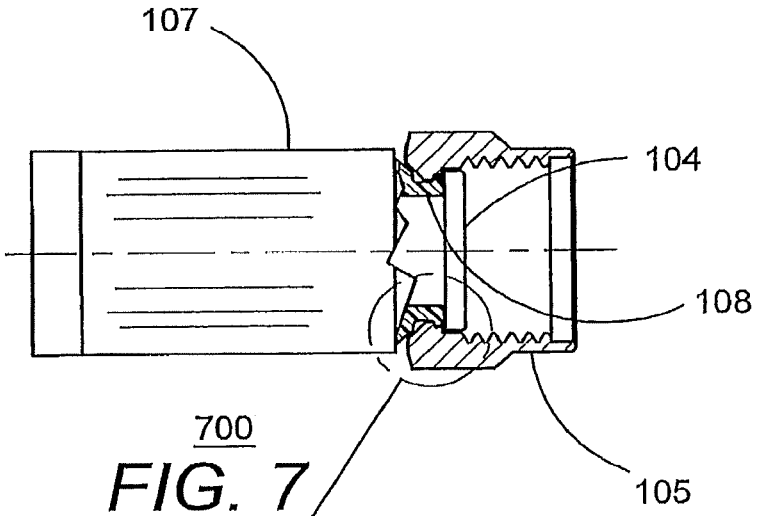
FIG. 7 is a partial cross-sectional view of a second alternate embodiment of an F connector having a second alternate grounding member.
Figure 7A:
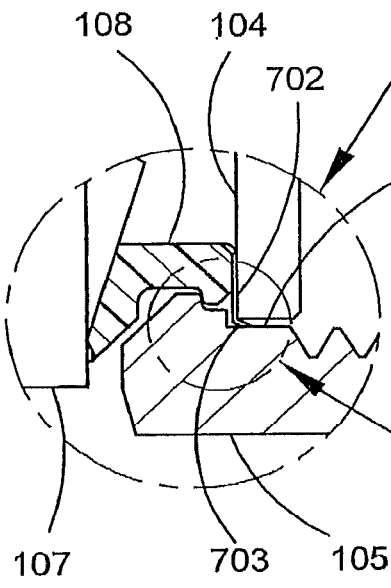
FIG. 7A is an enlargement of a portion of FIG. 7.
Figure 7B:
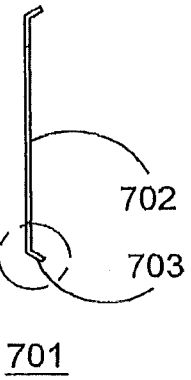
FIG. 7B is a slightly enlarged side view of the second alternate grounding member of FIG. 7.
Figure 7C:
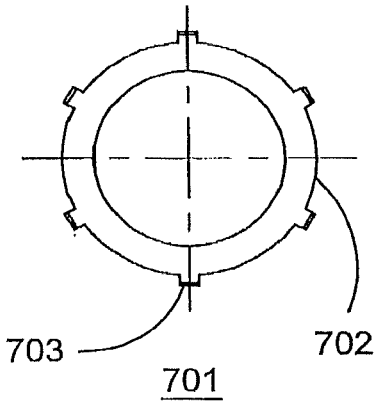
FIG. 7C is a slightly enlarged plan view of the second alternate grounding member of FIG. 7.

FIG. 7 is a partial cross-sectional view of a second alternate embodiment of a connector 700 having a second alternate grounding member 701 (see FIGS. 7A-7C). FIG. 7A is an enlargement of a portion of the second alternate embodiment of the connector 700, showing a portion of the second alternate grounding member 701. FIG. 7B is a slightly enlarged side view of the second alternate grounding member 701. FIG. 7C is a slightly enlarged plan view of the second alternate grounding member 701. Referring now to FIGS. 7, 7A, 7B and 7C, the second alternate grounding member 701 is a radial grounding member retained between the coupling nut 105 and the tubular post 104. The second alternate grounding member 701 is constructed of a thin cross section of metallic material such as beryllium copper. The second alternate grounding member 701 comprises a ring portion 702 and a plurality of fingers 703 extending radially from the ring portion at about a 45° angle from the plane of the ring portion. The spring action of the fingers 703 extend to inner-diameter surfaces 705 of the coupling nut 105, and serve to connect a ground path from the coupling nut to the tubular post 104 while allowing the coupling nut to rotate.

Figure 8:
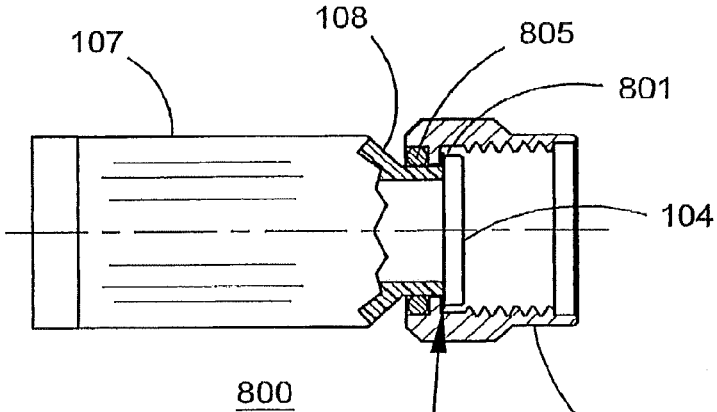
FIG. 8 is a partial cross-sectional view of a third alternate embodiment of an F connector having a third alternate grounding member.
Figure 8B:
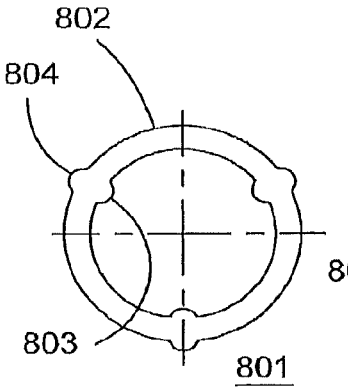
FIGS. 8B-8E are slightly enlarged plan views of four styles of the third alternate grounding member of FIG. 8.
Figure 8C:
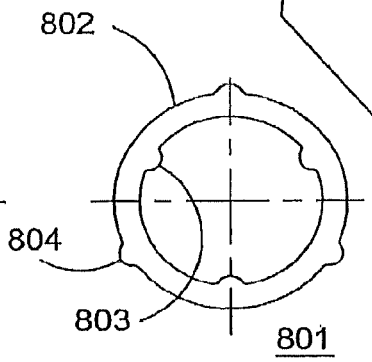
Figure 8A:
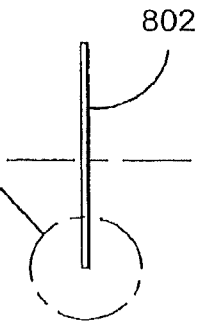
FIG. 8A is a slightly enlarged side view of the third alternate grounding member of FIG. 8.
Figure 8D:
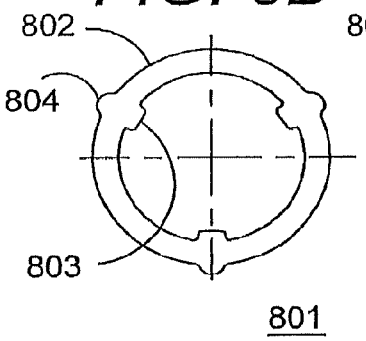
Figure 8E:
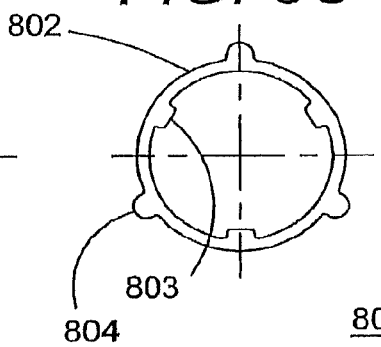

FIG. 8 is a partial cross-sectional view of a third alternate embodiment of a connector 800 having a third alternate grounding member 801 (see FIGS. 8A-8E), FIG. 8A is a slightly enlarged side view of the third alternate grounding member 801. FIGS. 8B-8E are slightly enlarged plan views of four styles of the third alternate grounding member 801. Referring now to FIG. 8 and FIGS. 8A-8E, the third alternate grounding member 801 is a conductive member retained between the coupling nut 105 and the tubular post 104. The third alternate grounding member 801 is constructed of a thin cross section of metallic material such as brass or beryllium copper. The third alternate grounding member 801 comprises a ring 802 with multiple points of contact, or internal lugs, 803 around the inner perimeter of the ring and with multiple external lugs 804 around the outer perimeter of the ring. The lugs 803 and 804 serve to connect a ground path from the coupling nut 105 to the tubular post 104 while allowing the coupling nut to rotate. FIGS. 8B-8E show four styles with regard to the shape of the lugs 803 and 804 and the position of the lugs on the ring 802. FIG. 8 also exhibits an alternate embodiment comprising a sealing ring 805 for forming a moisture seal between the coupling nut 105 and the body 108 of the connector 801. The sealing ring 805 is disposed between the back end of the coupling nut 105 and the body 108 for forming a seal therebetween. Preferably, the sealing ring 805 is made from ethylene propylene. Use of the sealing ring 805 is not limited to use in connectors having the third alternate grounding member 801. The third alternate grounding member 801 may also be used in connectors without the sealing ring 805.

Figure 9:
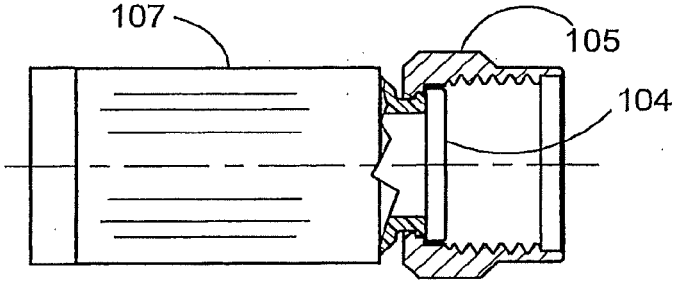
FIG. 9 is a partial cross-sectional view of a fourth alternate embodiment of an F connector having one of a fourth alternate grounding member and a fifth alternate grounding member.
Figure 9A:
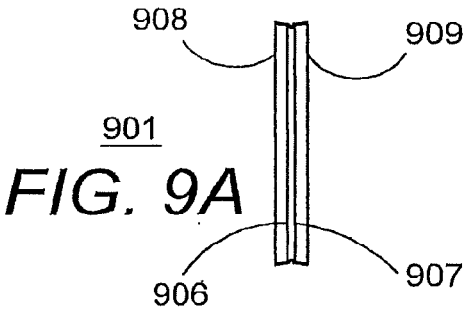
FIG. 9A is a slightly enlarged side view of the fourth alternate grounding member of FIG. 9.
Figure 9B:
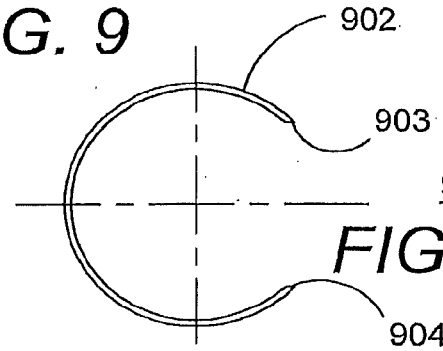
FIG. 9B is a slightly enlarged plan view of the fourth alternate grounding member of FIG. 9.
Figure 9C:
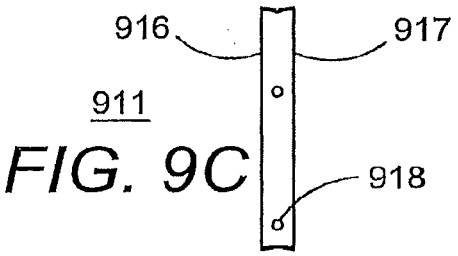
FIG. 9C is a slightly enlarged side view of the fifth alternate grounding member of FIG. 9.
Figure 9D:
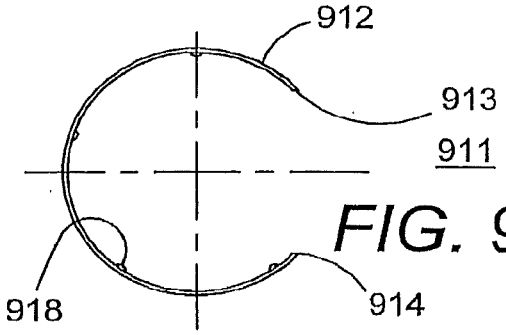
FIG. 9D is a slightly enlarged plan view of the fifth alternate grounding member of FIG. 9.
Figure 10:
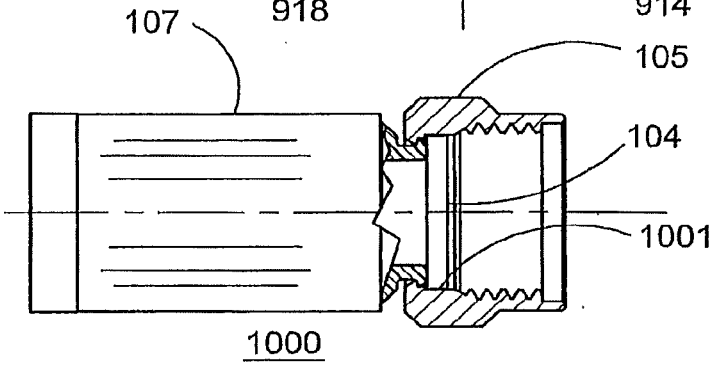
FIG. 10 is a partial cross-sectional view of a fifth alternate embodiment of an F connector having conductive grease that acts as a grounding member.

FIG. 9 is a partial cross-sectional view of a fourth alternate embodiment of a connector 900 having one of a fourth alternate grounding member 901 and a fifth alternate grounding member 911 (see FIGS. 9A-9D). FIG. 9A is a slightly enlarged side view of the fourth alternate grounding member 901. FIG. 9B is a slightly enlarged plan view of the fourth alternate grounding member 901. FIG. 9C is a slightly enlarged side view of the fifth alternate grounding member 902. FIG. 9D is a slightly enlarged plan view of the fifth alternate grounding member 911. The fourth and filth alternate embodiments of the grounding member 901 and 911, respectively, comprise a C-shaped ring between the coupling nut 105 and the tubular post 104. The C-shaped ring is constructed of a thin cross section of metallic material such as beryllium copper or stainless steel. It is retained by a groove in the coupling nut. The spring action of the C-shaped ring serves to connect a ground path from the coupling nut 105 to the tubular post 104 while allowing the coupling nut to rotate. The fourth alternate grounding member 901 includes a circumferential metallic band 902, which has a general circular shape and approximates a section of a hollow cylinder, that extends between first 903 and second 904 opposing ends. The band 902 has first 906 and second 907 opposing side edges extending along its length. The fourth alternate grounding member 901 includes a first generally radial wall 908 extending from the first side edge 906 of the band in a first radial direction, and a second generally radial wall 909 extending from the second side edge 907 of the band generally in said first radial direction. The band 902 contacts a first one of the group of members that includes the coupling nut 105 and the tubular post 104. The first 908 and second 909 radial walls contact the second of the group of members that includes the coupling nut 105 and the tubular post 104. The fifth alternate grounding member 911 includes a metallic band 912 extending along its length between first 913 and second 914 opposing ends, and extending along its width between first 916 and second 917 side edges. The band 912 is formed along its length into a generally circular shape. The band 912 is formed along its width into a generally concave shape with the side edges 916 and 917 projecting generally in a first radial direction. The fifth alternate grounding member 911 includes a plurality of projections 918 extending from the band 912 in a second radial direction opposite to the first radial direction. The first 916 and second 917 side edges of the band 912 contact a first one of the group of members that includes the coupling nut and the tubular post. The plurality of projections 918 contact the second of the group of members that includes the coupling nut 105 and the tubular post 104, FIG. 10 is a partial cross-sectional view of a fifth alternate embodiment of a connector 1000 having conductive grease (not shown) that acts as a grounding member. The ground path is established by means of a close fit between the coupling nut 105 and the tubular post 104. The conductive grease is disposed at a grease annular ring 1001 where mating portions of the tubular post 104 and coupling nut 105 have closely matching dimensions. Preferably, the conductive grease is a silver-loaded silicon lubricating material. The conductive grease serves to connect a ground path from the coupling nut 105 to the tubular post 104 while allowing the coupling nut to rotate.

Figure 11:
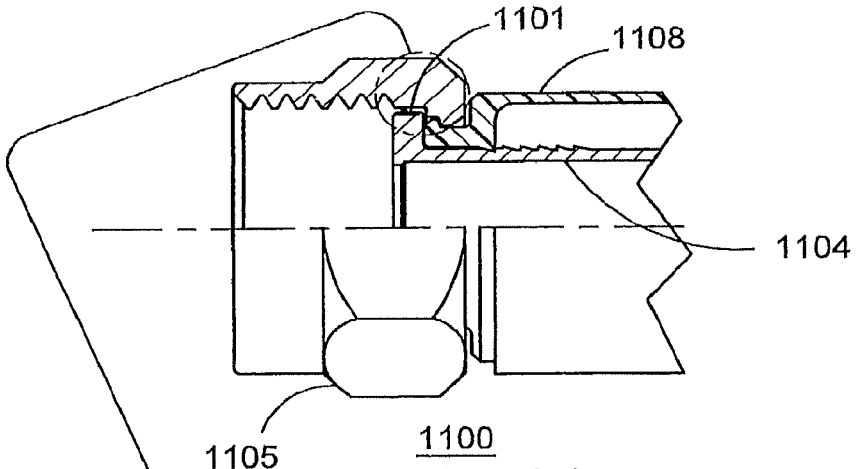
FIG. 11 is a partial cross-sectional view of a front end of a sixth alternate embodiment of an F connector having a sixth alternate grounding member.
Figure 11A:
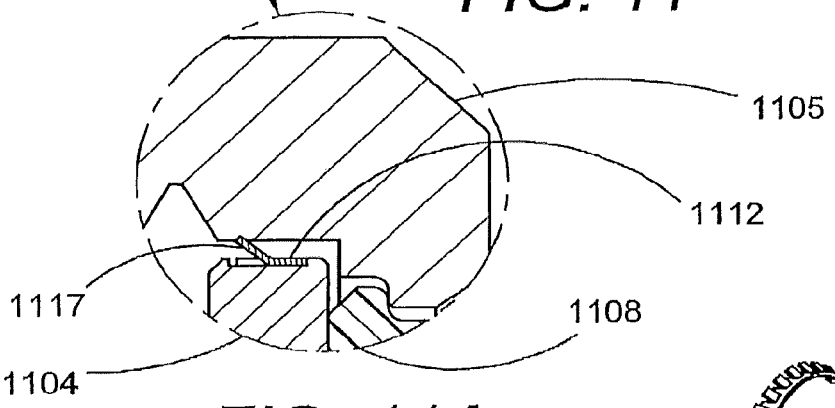
FIG. 11A is an enlargement of a portion of FIG. 11.
Figure 11D:
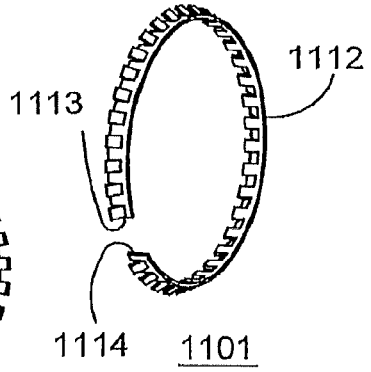
FIG. 11D is a perspective view of the sixth alternate grounding member of FIG. 11.
Figure 11B:
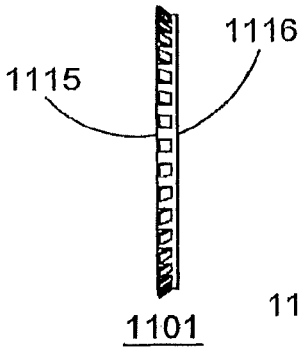
FIG. 11B is a side view of the sixth alternate grounding member of FIG. 11.
Figure 11C:
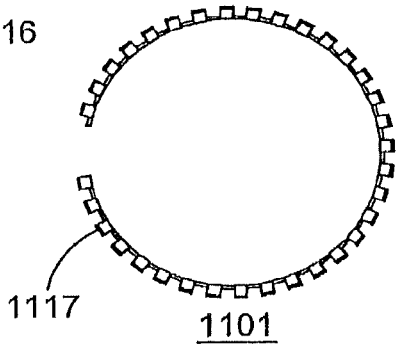
FIG. 11C is a plan view of the sixth alternate grounding member of FIG. 11.

FIG. 11 is a partial cross-sectional view of a front end of a sixth alternate embodiment of an F connector 1100 that includes a body 1108, and which has a sixth alternate grounding member 1101. FIG. 11A is an enlargement of a portion of FIG. 11. FIG. 11B is a side view of the sixth alternate grounding member 1101. FIG. 11C is a plan view of the sixth alternate grounding member 1101. FIG. 11D is a perspective view of the sixth alternate grounding member 1101. Referring now to FIG. 11 and FIGS. 11A-11D, the sixth alternate grounding member 1101 includes a circumferential metallic band 1112 extending between first 1113 and second 1114 opposing ends. The band 1112 has a generally circular shape that approximates a section of a hollow cylinder. The first 1113 and second 1114 ends of the band 1112 are disposed generally proximate to each other and are directed generally toward one another. The band 1112 has first and second opposing side edges 1115 and 1116, respectively, extending along its length. The band generally de fines a section of a cylindrical surface. The sixth alternate grounding member 1101 includes a plurality of projections 1101 extending from at least one of the first and second side edges 1115 and 1116 of the band 1112. The plurality of projections 1117 extend away from the cylindrical surface defined by the band 1112. The band 1112 contacts a first one of the group of members that includes the coupling nut 1105 and the tubular post 1104. The plurality of projections 1117 contact the second of the group of members that includes the coupling nut 1105 and the tubular post 1104.

In preferred embodiments, the present invention provides a coaxial cable connector that ensures a reliable grounding path without creating undue interference with free rotation of the coupler relative to the remaining components of the connector; however, the present invention can also provide a reliable grounding path between a post and a coupler that does not rotate. Advantageously, a connector in accordance with the invention works with standard installation tools and with standard compression tools. The present invention can be used with both axially-compressible connectors as well as with older-style crimp-ring connectors. In some embodiments, the present invention is compatible with the use of a sealing ring for forming a moisture seal between the coupler and the outer body of the connector.

While the present invention has been described with respect to preferred embodiments thereof, such description is for illustrative purposes only, and is not to be construed as limiting the scope of the invention. Various modifications and changes may be made to the described embodiments by those skilled in the art without departing from the true spirit and scope of the invention as defined by the appended claims. For example, the grounding member can have a shape other than generally circular, such as square, hexagonal, octagonal, oval, etc.

LIST OF REFERENCE NUMERALS

100 F connector ("connector")
101 Longitudinal axis
102 Front end

103 Back end
104 Tubular post
105 Coupling nut
106 End of tubular post
107 Shell
108 Body
109 Label
110 Grounding member
111 Neck
201 Minimum diameter
203 Maximum diameter
301 Coaxial cable
302 Center conductor
303 Dielectric material
304 Outer conductor
305 Jacket
310 Lip of body
311 Outer diameter of lip body
312 Inner diameter of lip of body
330 Head of tubular post
332 Shoulder of tubular post
333 First radial face of shoulder of tubular post
334 Outer surface of shoulder
336 Outer diameter of shoulder
337 Outer diameter of non-shoulder portion of post
338 Non-shoulder portion of post
340 Inwardly-directed flange of coupling nut
341 Inner diameter of inwardly-directed flange
342 Bore of coupling nut
343 Annular recess of coupling nut
344 Inner diameter of bore of coupling nut
600 First alternate connector
601 First alternate grounding member
602 Ring portion of first alternate grounding member
603 Fingers of first alternate grounding member
604 Radial surface of coupling nut
605 Internal lugs of first alternate grounding member
700 Second alternate connector
701 Second alternate grounding member
702 Ring portion of second alternate grounding member
703 Fingers of second alternate grounding member
800 Third alternate connector
801 Third alternate grounding member
802 Ring portion of third alternate grounding member
803 Internal lugs of third alternate grounding member
804 External lugs of third alternate grounding member
805 Sealing ring
900 Fourth alternate connector
901 Fourth alternate grounding member
902 Band of fourth alternate grounding member
903 First end of band
904 Second end of band
906 First side edge of band
907 Second side edge of band
908 First radial wall of band
909 Second radial wall of band
911 Fifth alternate grounding member
1000 Fifth alternate connector
1001 Grease annular ring
1100 Sixth alternate connector
1101 Sixth alternate grounding member
1104 Tubular post of sixth alternate connector
1105 Coupling nut of sixth alternate connector
1108 Body of sixth alternate connector
1112 Band of sixth alternate grounding member
1113 First end of band
1114 Second end of band
1115 First side edge of band
1116 Second side edge of band
1117 Projections on band

We claim:

1. A coaxial cable connector for coupling a coaxial cable to an equipment port, the coaxial cable including a center conductor surrounded by a dielectric material, the dielectric material being surrounded by an outer conductor, the coaxial cable connector comprising:

a post including a first end adapted to be inserted into a prepared end of the coaxial cable between the dielectric material and the outer conductor, wherein the post includes a second end including an enlarged shoulder, wherein the enlarged shoulder has a radial face that faces away from the first end of the post, wherein the radial face is substantially flat;

a body member adjacent to the post;

a coupler including an internally-threaded region for engaging the equipment port and an inwardly directed flange having a forward face; and a grounding member configured to be inserted forward of at least a portion of the forward face of the inwardly directed flange of the coupler and rearward of the radial face of the post, the grounding member contacting the post and the coupler and configured to provide an electrically-conductive grounding path through the post and the coupler while allowing the coupler to rotate, wherein the grounding member includes a first portion configured to contact the coupler while allowing the coupler to rotate and a second portion configured to contact the post, the first and second portions of the grounding member existing in a plane of the grounding member, wherein the second portion of the grounding member comprises a plurality of internal lugs configured to contact the post.

2. The coaxial cable connector of claim 1, wherein the grounding member is formed from a metal.

3. The coaxial cable connector of claim 1, wherein the body member is formed from a plastic.

4. The coaxial cable connector of claim 1, wherein the first portion of the grounding member comprises a plurality of external lugs configured to contact the coupler.

5. A coaxial cable connector for coupling a coaxial cable to an equipment port, the coaxial cable including a center conductor surrounded by a dielectric material, the dielectric material being surrounded by an outer conductor, the coaxial cable connector comprising:

a tubular post having a first end adapted to be inserted into the prepared end of the coaxial cable between the dielectric material and the outer conductor to reliably contact the outer conductor, and having a second end opposite the first end;

a coupler having a first end rotatably secured over the second end of the tubular post, and having an opposing second end, the coupler including a central bore extending therethrough, a portion of the central bore proximate the second end of the coupler being adapted for engaging the equipment port;

a body member secured to the tubular post and extending about the first end of the tubular post for receiving the outer conductor of the coaxial cable; and an electrically-conductive grounding component disposed between the tubular post and the coupler;

wherein the tubular post includes a tubular post grounding path portion having an outer surface, and the coupler includes a coupler grounding path portion having an inner surface; and wherein the electrically-conductive grounding component reliably contacts both the tubular post grounding path portion and the coupler grounding path portion to provide a stable and reliable electrically-conductive grounding path between the tubular post grounding path portion and the coupler grounding path portion when a gap between the tubular post and the equipment port exists while the coupler is engaged with the equipment port.

6. The coaxial cable connector of claim 5, wherein the electrically-conductive grounding component is at least one of a resilient electrically-conductive grounding member and electrically-conductive grease.

7. The coaxial cable connector of claim 5, wherein the electrically-conductive grounding component is an arcuately shaped resilient electrically-conductive grounding member configured to extend around the tubular post over at least 225 degrees.

8. The coaxial cable connector of claim 5, wherein the coupler includes an annular recess configured to engage and retain the electrically-conductive grounding component.

9. The coaxial cable connector of claim 1, wherein the grounding component is a resilient electrically-conductive grounding member having engagement portions configured to reliably contact the tubular post grounding path portion and engagement portions configured to reliably contact the coupler grounding path portion.

10. The coaxial cable connector of claim 9, wherein the engagement portions of the resilient electrically-conductive grounding member configured to reliably contact the tubular post grounding path portion are internal lugs distributed along an inner perimeter of the resilient electrically-conductive grounding member.

11. The coaxial cable connector of claim 9, wherein the engagement portions of the resilient electrically-conductive grounding member configured to reliably contact the coupler grounding path portion extend outward from non-engagement portions of the resilient electrically-conductive grounding member.

12. The coaxial cable connector of claim 9, wherein the engagement portions of the resilient electrically-conductive grounding member configured to reliably contact a shoulder of the tubular post located at the second end of the tubular post, the shoulder of the tubular post comprising the tubular post grounding path portion.

13. The coaxial cable connector of claim 9, wherein at the engagement portions of the resilient electrically-conductive grounding member are resilient.

14. The coaxial cable connector of claim 11, wherein the engagement portions of the resilient electrically-conductive grounding member configured to reliably contact the coupler grounding path portion extend away from a plane defined by the non-engagement portions of the resilient electrically-conductive grounding member.

15. The coaxial cable connector of claim 5, wherein the grounding component is retained between the tubular post and the coupler.

* * * * *